US010347212B2

(12) United States Patent
Yamazaki et al.

(10) Patent No.: US 10,347,212 B2
(45) Date of Patent: Jul. 9, 2019

(54) METHOD FOR DRIVING INFORMATION PROCESSING DEVICE, PROGRAM, AND INFORMATION PROCESSING DEVICE

(71) Applicant: Semiconductor Energy Laboratory Co., Ltd., Atsugi-shi, Kanagawa-ken (JP)

(72) Inventors: Shunpei Yamazaki, Setagaya (JP); Yuji Iwaki, Isehara (JP); Jiro Imada, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 15/384,865

(22) Filed: Dec. 20, 2016

(65) Prior Publication Data

US 2017/0103730 A1 Apr. 13, 2017

Related U.S. Application Data

(63) Continuation of application No. 14/077,379, filed on Nov. 12, 2013, now Pat. No. 9,569,992.

(30) Foreign Application Priority Data

Nov. 15, 2012 (JP) ..... 2012-251548

(51) Int. Cl.
*G09G 5/00* (2006.01)
*G09G 5/10* (2006.01)
(Continued)

(52) U.S. Cl.
CPC ..... *G09G 5/10* (2013.01); *G09G 3/20* (2013.01); *G09G 3/2018* (2013.01); *G09G 5/34* (2013.01);
(Continued)

(58) Field of Classification Search
CPC ..... G09G 2320/103; G09G 2320/0257; G09G 3/3406; G09G 2320/0233;
(Continued)

(56) References Cited

U.S. PATENT DOCUMENTS 4,878,748 A 11/1989 Johansen
5,534,884 A 7/1996 Mase et al.
(Continued)

FOREIGN PATENT DOCUMENTS

JP 2000-122620 A 4/2000
JP 2001-022508 A 1/2001
(Continued)

*Primary Examiner* — Duc Q Dinh
(74) *Attorney, Agent, or Firm* — Robinson Intellectual Property Law Office; Eric J. Robinson

(57) ABSTRACT

An information processing device including a display unit and an input unit is driven by a first step of inputting an input signal from the input unit, a second step of starting to move an image displayed on the display unit, a third step of lowering luminance of the image, a fourth step of checking whether the image reaches a position of predetermined coordinates, a fifth step of increasing the luminance of the image in the case where the image reaches the position of the predetermined coordinates, and a sixth step of stopping moving the image so as to perform eye-friendly display with the display unit.

21 Claims, 21 Drawing Sheets

(51) Int. Cl.
*G09G 3/20* (2006.01)
*G09G 5/34* (2006.01)
*G09G 3/36* (2006.01)

(52) U.S. Cl.
CPC ... *G09G 3/3648* (2013.01); *G09G 2320/0247* (2013.01); *G09G 2320/0261* (2013.01); *G09G 2320/0626* (2013.01); *G09G 2320/0646* (2013.01); *G09G 2340/0435* (2013.01)

(58) Field of Classification Search
CPC ..... G09G 2320/062; G09G 2360/16; G09G 5/008; G09G 2320/0261; G09G 2320/0252; G09G 3/3648; G09G 2310/024; G06F 11/1438; G06F 11/1441; G06F 17/30; G06F 21/568; G06F 21/575; G06F 2203/04801; G06F 3/0412; G06F 3/044; G06F 3/0481; G06F 9/4406; G06F 9/4418; G06F 2203/04103; G06F 3/0416; G06F 3/0485; G06F 3/04855; H01L 29/7869; H01L 27/1225
See application file for complete search history.

(56) References Cited

U.S. PATENT DOCUMENTS 6,825,834 B2 11/2004 Miyajima
6,958,744 B2 10/2005 Nakamura
7,212,185 B2 5/2007 Yanagi et
7,317,438 B2 1/2008 Yamazaki et al.
7,333,165 B2 2/2008 Nakano et al.
7,480,870 B2 1/2009 Anzures et al.
7,724,247 B2 5/2010 Yamazaki et al.
7,773,102 B2 8/2010 Lee
7,782,283 B2 8/2010 Hong et al.
7,989,274 B2 8/2011 Kang et al.
8,299,461 B2 10/2012 Tanaka et al.
8,487,923 B2 7/2013 Kimura
8,664,652 B2 3/2014 Yamazaki et al.
8,686,425 B2 4/2014 Yamazaki et al.
8,692,252 B2 4/2014 Takata et al.
8,817,009 B2 8/2014 Hayakawa et al.
8,952,377 B2 2/2015 Yamazaki et al.
9,006,025 B2 4/2015 Yamazaki et al.
9,054,134 B2 6/2015 Yamazaki et al.
9,196,745 B2 11/2015 Yamazaki et al.
9,214,474 B2 12/2015 Yamazaki
9,437,743 B2 9/2016 Mizoguchi et al.
9,530,897 B2 12/2016 Yamazaki et al.
9,698,275 B2 7/2017 Yamazaki
9,859,401 B2 1/2018 Yamazaki et al.
2005/0146492 A1 7/2005 Baba et al.
2005/0146532 A1 7/2005 Miyazaki et al.
2008/0055318 A1* 3/2008 Glen ..... G09G 3/20 345/501
2008/0165103 A1 7/2008 Lee
2008/0165204 A1 7/2008 Klompenhouwer et al.
2009/0058842 A1 3/2009 Bull et al.
2009/0256795 A1 10/2009 Naum et al.
2009/0267963 A1 10/2009 Kawashima et al.
2010/0253711 A1 10/2010 Muroi
2010/0259569 A1 10/2010 Inuzuka
2010/0314618 A1* 12/2010 Tanaka ..... H01L 21/02554 257/43
2010/0321411 A1* 12/2010 Paek ..... G06F 3/04883 345/684
2011/0109541 A1* 5/2011 Kitagawa ..... B60K 35/00 345/156
2011/0149185 A1 6/2011 Yamazaki
2011/0157131 A1 6/2011 Miyake
2011/0210957 A1 9/2011 Koyama et al.
2011/0267381 A1 11/2011 Yamazaki et al.
2012/0149139 A1* 6/2012 Tanaka ..... G02F 1/133707 438/34
2012/0280227 A1 11/2012 Wakana et al.
2013/0106690 A1* 5/2013 Lim ..... G07F 13/065 345/156
2013/0300777 A1 11/2013 Kimura
2015/0194535 A1 7/2015 Yamazaki et al.
2016/0336459 A1 11/2016 Mizoguchi et al.
2017/0309753 A1 10/2017 Yamazaki et al.

FOREIGN PATENT DOCUMENTS

JP 2002-077762 A 3/2002
JP 2003-047636 A 2/2003
JP 2005-195734 A 7/2005
JP 2009-187467 A 8/2009
JP 2010-224531 A 10/2010
JP 2010-287735 A 12/2010
JP 2011-124360 A 6/2011
JP 2011-151394 A 8/2011
JP 2011-170328 A 9/2011
JP 2011-170501 A 9/2011
JP 2011-243745 A 12/2011
JP 2012-099796 A 5/2012
WO WO-2011/065329 6/2011
WO WO-2011/077966 6/2011
WO WO-2011/089832 7/2011

* cited by examiner

METHOD FOR DRIVING INFORMATION PROCESSING DEVICE, PROGRAM, AND INFORMATION PROCESSING DEVICE

BACKGROUND OF THE INVENTION

1. Field of the Invention

The present invention relates to an information processing device and a method for driving the information processing device. The present invention also relates to a program for driving the information processing device.

2. Description of the Related Art

In recent years, information processing devices each provided with an input unit, a display unit, and an arithmetic unit have been prevalent.

As the display unit, a variety of display units such as a liquid crystal display, a display device including an organic electroluminescence (EL) element, and an electronic paper are employed.

Examples of input units include a keyboard and a pointing device. Further, recently, a touch panel which can sense contact or proximity of an operating body, a gesture input unit which can sense the motion of the human hand or finger, and the like have been widely used.

For example, an information display device including a touch panel and a liquid crystal display panel is described in Patent Document 1.

On the other hand, eye fatigue (also called eye strain) is known to be accumulated by long-time viewing of a display device (e.g., Patent Document 2).

REFERENCE

Patent Document

[Patent Document 1] Japanese Published Patent Application No. 2001-022508

[Patent Document 2] Japanese Published Patent Application No. 2003-047636

SUMMARY OF THE INVENTION

An object of one embodiment of the present invention is to reduce eye fatigue of a user and achieve an eye-friendly display.

One embodiment of the present invention is a method for driving an information processing display including a display unit and an input unit, which includes a first step of inputting an input signal from the input unit; a second step of starting to move an image that is displayed on the display unit in accordance with the input signal; a third step of lowering a luminance of the image; a fourth step of checking whether the image reaches a position of predetermined coordinates; a fifth step of increasing the luminance of the image when the coordinate of the image reaches the predetermined coordinate; and a sixth step of stopping moving the image.

Another embodiment of the present invention is a method for driving an information processing device including a display unit and an input unit, which includes a first step of inputting an input signal from the input unit; a second step of starting to move an image that is displayed on the display unit in accordance with the input signal; a third step of lowering a luminance of the image gradually; a fourth step of checking whether the image reaches a position of predetermined coordinates; a fifth step of increasing the luminance of the image gradually when the image reaches the position of predetermined coordinates; and a sixth step of stopping moving the image.

Further, in any of the above methods for driving an information processing device, during a period from the second step to the sixth step, a refresh rate of rewriting an image displayed on the display unit (hereinafter, refresh rate of display on the display unit) is preferably set to higher than or equal to 30 Hz, and after the sixth step, a seventh step in which the refresh rate of display on the display unit is set to lower than or equal to 5 Hz is performed.

Another embodiment of the present invention is a program for driving an image processing device including a display unit, an input unit, and an arithmetic unit. By the program, the arithmetic unit executes a first step of inputting an input signal from the input unit; a second step of starting to move an image that is displayed on the display unit in accordance with the input signal; a third step of lowering a luminance of the image; a fourth step of checking whether the image reaches a position of predetermined coordinates; a fifth step of increasing the luminance of the image when the image reaches the position of predetermined coordinates; and a sixth step of stopping moving the image.

Another embodiment of the present invention is a program for driving an image processing device including a display unit, an input unit, and an arithmetic unit. By the program, the arithmetic unit executes a first step of inputting an input signal from the input unit; a second step of starting to move an image that is displayed on the display unit in accordance with the input signal; a third step of lowering a luminance of the image gradually; a fourth step of checking whether the image reaches a position of predetermined coordinates; a fifth step of increasing the luminance of the image gradually when the image reaches the position of predetermined coordinates; and a sixth step of stopping moving the image.

Further, in any of the programs, during a period from the second step to the sixth step, a refresh rate of display on the display unit is preferably set to higher than or equal to 30 Hz, and after the sixth step, a seventh step in which the refresh rate of display on the display unit is set to lower than or equal to 5 Hz is performed.

Another embodiment of the present invention is an information processing device including a display unit, an input unit, an arithmetic unit, and a memory unit, and in the memory unit, any of the programs is stored.

According to one embodiment of the present invention, an information processing device which gives a user less eye fatigue and can perform eye-friendly display can be provided.

DETAILED DESCRIPTION OF THE INVENTION

Figure 1:
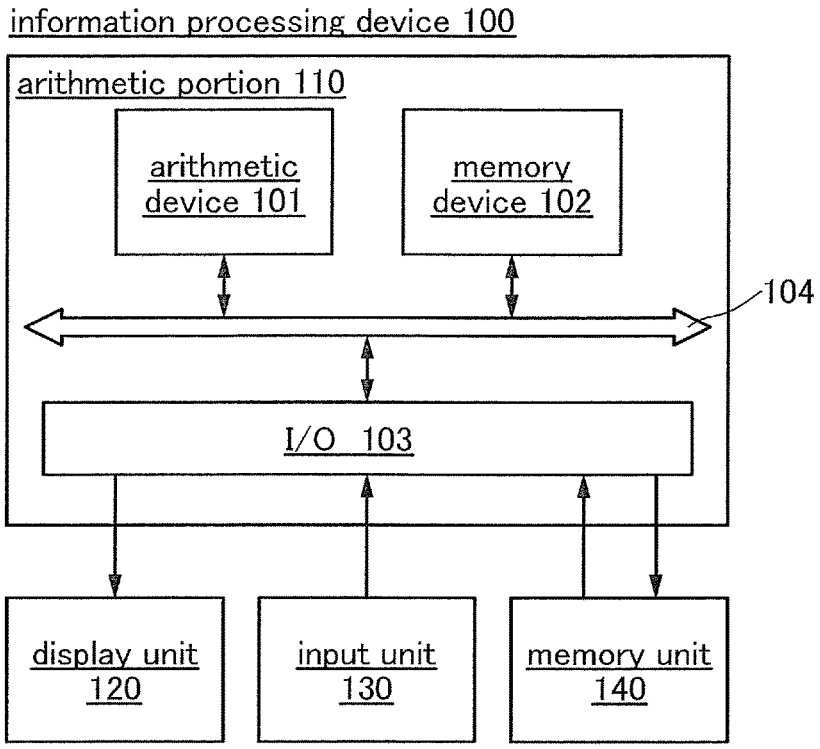
FIG. 1 illustrates a structure example of an information processing device according to Embodiment.

Embodiments are described in detail with reference to the accompanying drawings. Note that the invention is not limited to the following description, and it will be easily understood by those skilled in the art that various changes and modifications can be made without departing from the spirit and scope of the invention. Therefore, the invention should not be construed as being limited to the description in the following embodiments. Note that in the structures of the invention described below, the same portions or portions having similar functions are denoted by the same reference numerals in different drawings, and description of such portions is not repeated.

(Embodiment 1)

Images displayed on a display unit of an information processing device are classified roughly into moving images and still images.

Frequency of displaying still images on a display unit is comparatively higher than frequency of displaying moving images on the display unit, for example, broadcasting television programs, displaying a moving image file such as a movie, or the like. For example, in the case of using a word processor or executing spreadsheet software, still images such as character data are displayed on a display unit. There is a case where still images including image data such as photographs or illustrations are displayed. Further, there is a case where still images including both character data and image data are displayed, e.g., a case of viewing Web pages.

Furthermore, there is a case where a user transfers a displayed still image with an input unit to display another still image. For example, in the case where a still image such as a photograph is viewed, a displayed still image is switched to a next still image to be displayed by sliding the already displayed still image. Further, in the case where image data exists beyond an area capable of being displayed on a display unit, a region beyond the area can be displayed by scrolling.

When transferring a still image, the user often follows the transferring image with his/her eyes unconsciously. The user action of focusing his/her eyes on the image that is relatively rapidly transferring gives eye fatigue to the user, and by repeating the action, the fatigue is accumulated.

An object of one embodiment of the present invention is to reduce eye fatigue of a user caused by an action of transferring a still image and perform eye-friendly display.

An information processing device of one embodiment of the present invention and a driving method thereof are described below with reference to the drawings.

[Information Processing Device]

FIG. 1 illustrates a structural example of an information processing device 100 described below. The information processing device 100 of one embodiment of the present invention includes an arithmetic portion 110, a display unit 120, an input unit 130, and a memory unit 140.

[Arithmetic Portion]

The arithmetic portion 110 can output an image signal, a synchronization signal such as a vertical synchronization signal or a horizontal synchronization signal, a clock signal, and the like to the display unit 120.

The arithmetic portion 110 includes an arithmetic device 101, a memory device 102, an input-output interface (I/O) 103, and a transmission path 104.

The transmission path 104 connects the arithmetic device 101, the memory device 102, and the I/O 103 to each other and transmits data. The arithmetic portion 110 can transmit and receive data via the I/O 103 to/from the display unit 120, the input unit 130, and the memory unit 140. For example, an input signal from the input unit 130 is transferred from the I/O to the arithmetic device 101 through the transmission path 104.

The memory device 102 temporarily stores image data or a program executed by the arithmetic device 101.

The arithmetic device 101 executes a program. For example, the arithmetic device 101 can analyze an input signal from the input unit 130, read data from the memory unit 140, write data to the memory unit 140, and generate and output a signal to the display unit 120, depending on programs to be executed.

[Display Unit]

The display unit 120 at least includes a display portion where an image is displayed. Images can be displayed on the display portion in accordance with signals input from the arithmetic portion 110.

The display portion in the display unit 120 includes a plurality of pixels. The pixels in the display portion are preferably arranged at a resolution of 150 ppi (pixel per inch) or more, preferably 200 ppi or more. Further, it is preferable that light emitted from the display portion do not include light with wavelengths shorter than or equal to 440 nm, preferably shorter than or equal to 420 nm. The display unit 120 which includes such a display portion having a resolution of at least 150 ppi or more and emitting light from which light with wavelengths shorter than or equal to 420 nm is removed can suppress eye strain of a user (causes less eye fatigue). Accordingly, such a display unit can be referred to as a display unit capable of "eye-friendly" display.

[Input Unit]

The input unit 130 converts data inputted by a user into an input signal and outputs the signal to the arithmetic portion 110. As the input unit, various human interface devices can be used. For example, a keyboard, a pointing device, a touch panel, a sensor which can sense gesture, motion of eyes, or the like, and the like can be used. Further, with use of a microphone as the input unit, data may be input by voice recognition.

[Memory Unit]

The memory unit 140 can store a program, image data, and the like. For example, a memory device having higher memory capacitance than the memory device 102 is preferably used. Note that it is acceptable that at least one of the memory unit 140 and the memory device 102 is provided.

That is the description of the structure example of the information processing device 100.

[Method for Driving Information Processing Device]

A method for driving an information processing device of one embodiment of the present invention is described with reference to FIG. 1 and a flow chart in FIG. 2.

First, the information processing device 100 starts operation (S-0). At this time, the arithmetic portion 110 executes a program. Specifically, at this time, the arithmetic portion 110 may read the program from the memory unit 140 to store the program in the memory device 102 temporarily and execute the program.

[First Step]

In a first step (S-1), a still image is displayed on the display portion of the display unit 120. At this time, the still image displayed on the display portion of the display unit 120 includes an image that should be transferred in a later step (the image is also referred to as an object image).

[Second Step]

In a second step (S-2), the information processing device 100 receives an input signal by the input unit 130. The arithmetic device 101 analyzes whether the input signal is an instruction of transferring the object image. In the case where the input signal is the instruction of transferring the object image, the operation proceeds to a next step.

At this time, on the basis of the input signal and present coordinates (also referred to as initial coordinates) of the image, the arithmetic device 101 calculates final coordinates of the image when transfer ends. Further, predetermined coordinates used for determination in a fifth step are calculated from the initial coordinates and the final coordinates.

[Third Step]

At a third step (S-3), the object image in the image displayed on the display unit 120 starts to transfer.

Here, the object image may be transferred at the constant speed or transferred in accordance with an acceleration coefficient which has been set in advance.

[Fourth Step]

In a fourth step (S-4), luminance of the image displayed on the display portion of the display unit 120 is lowered to the predetermined luminance. At this time, it is preferable that the luminance of the image displayed on the display portion of the display unit 120 be gradually lowered to the predetermined luminance.

Note that only luminance of the object image may be lowered, or the luminance of the entire image displayed on the display portion of the display unit 120 may be lowered.

The third step and the fourth step may be performed concurrently. Further, the fourth step may be performed before the third step. For example, the luminance of the image displayed on the display portion may be lowered concurrently with the transfer of the object image. Alternatively, after gradual lowering of the luminance of the image displayed on the display portion starts, the transfer of the object image may start.

[Fifth Step]

In the fifth step (S-5), whether the object image reaches a position of the predetermined coordinates (the coordinates of the object image are the predetermined coordinates) is checked. In the case where the object image reaches the position of the predetermined coordinates, the operation proceeds to a sixth step. In the case where the object image does not reach the position of the predetermined coordinates, the operation returns to the fourth step.

[Sixth Step]

In the sixth step (S-6), the luminance of the image displayed on the display portion of the display unit 120 is increased from the predetermined luminance to the original luminance. It is preferable that the luminance of the image displayed on the display portion of the display unit 120 be gradually increased from the predetermined luminance to the original luminance.

Note that only luminance of the object image may be increased, or the luminance of the entire image displayed on the display portion of the display unit 120 may be increased.

[Seventh Step]

In a seventh step (S-7), whether the object image reaches a position of the final coordinates is checked. In the case where the object image reaches the position of the final coordinates, the operation proceeds to an eighth step. In the case where the object image does not reach the position of the final coordinates, the operation returns to the sixth step.

At this point, in the case where the luminance of the image displayed on the display portion is gradually increased, a change in luminance may be continued in the seventh step even after the object image reaches the position of the final coordinates. Further, before the object image reaches the position of the final coordinates, the luminance of the image displayed on the display portion may reach the original luminance. In at least the case where the object image reaches the position of the final coordinates and the luminance of the image displayed on the display portion reaches the original luminance, the operation proceeds to the eighth step.

[Eighth Step]

In the eighth step (S-8), a still image is displayed on the display portion of the display unit 120. At this time, the still image displayed on the display portion of the display unit 120 includes the object image positioned on the final coordinates.

Through the steps, operation ends (S-9).

With use of such a driving method, even when a user follows the motion of an image with his/her eyes, eye fatigue of the user can be reduced because the luminance of the image is lowered. Thus, by such a driving method, eye-friendly display can be achieved.

Since the luminance is not changed rapidly but changed gradually, pupil contraction or dilation caused by a change in luminance gently occurs. Thus, eye strain relating to pupil contraction or dilation is suppressed, and eye fatigue of the user can be effectively reduced.

[Modification Example]

Another example of a method for driving an information processing device, which is partly different from the driving method described above, is described below, with reference to a flow chart in FIG. 3. Note that description of the same part as the above description may be skipped.

Figure 2:
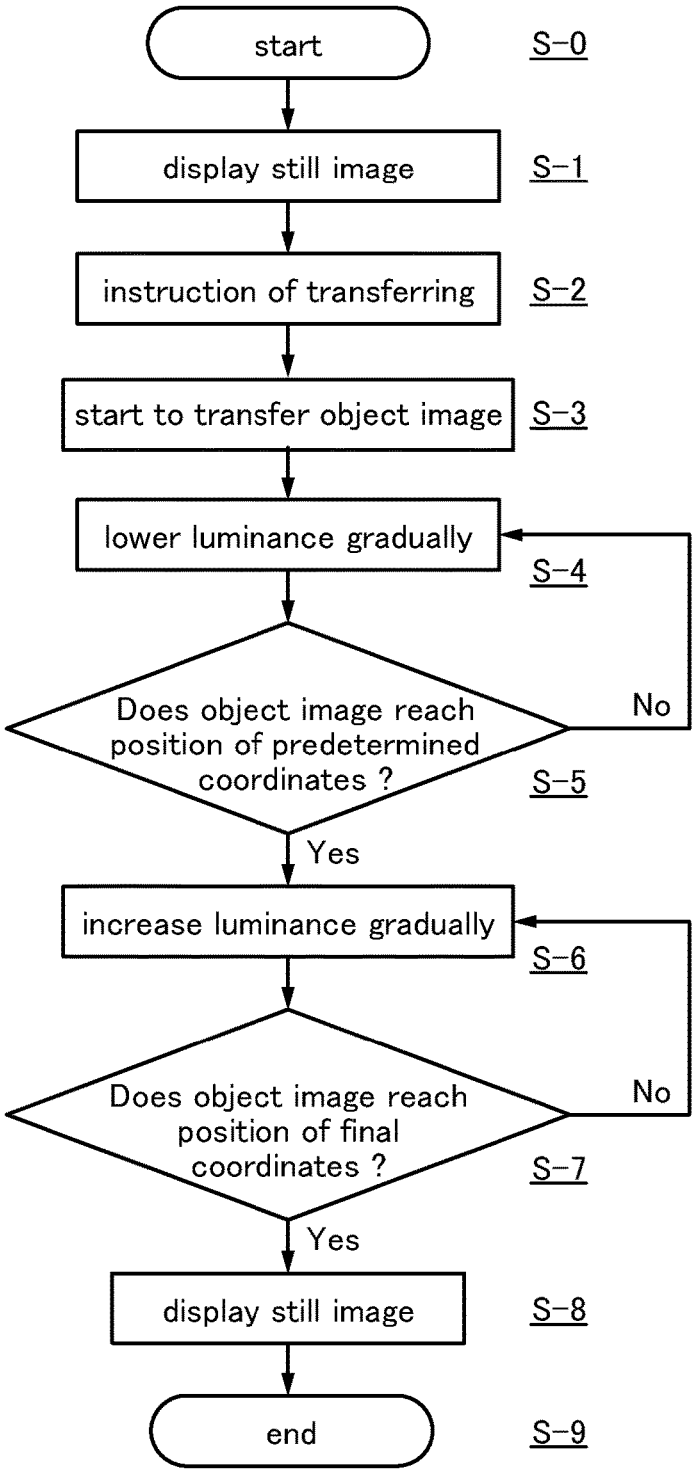
FIG. 2 is a flow chart showing an example of a method for driving an information processing device according to Embodiment.
Figure 3:
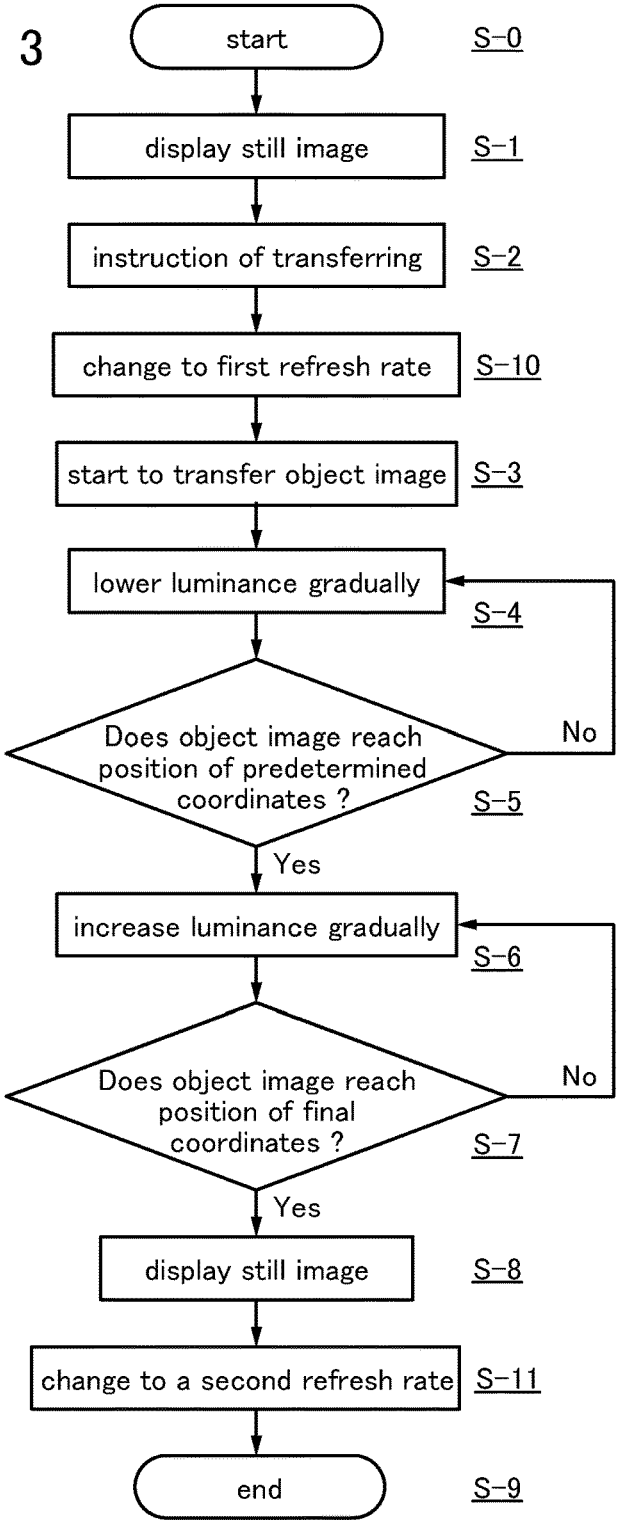
FIG. 3 is a flow chart showing an example of a method for driving an information processing device according to Embodiment.

The flow chart shown in FIG. 3 is different from the flow chart shown in FIG. 2 in that a tenth step is included between the second step and the third step and in that an eleventh step is included after the eighth step. Except for these two points, the flow chart in FIG. 3 is similar to that in FIG. 2.

[Tenth Step]

In the case where an instruction of transferring an object image is input in the second step (S-2), the operation proceeds to the tenth step.

In the tenth step (S-10), a refresh rate of a display on the display portion of the display unit 120 is set to a first refresh rate.

In this specification and the like, the refresh rate (also referred to as scan frequency or vertical synchronization frequency) is the rate (the number of times per unit time) at which display on a display unit is rewritten.

In this step, the first refresh rate is set to a value necessary for displaying a moving image. For example, the first refresh rate can be higher than or equal to 30 Hz and lower than or equal to 960 Hz, preferably higher than or equal to 60 Hz and lower than or equal to 960 Hz, further preferably higher than or equal to 75 Hz and lower than or equal to 960 Hz, still further preferably higher than or equal to 120 Hz and lower than or equal to 960 Hz, still further preferably higher than or equal to 240 Hz and lower than or equal to 960 Hz.

When the first refresh rate is set to a high value, a moving image can be displayed further smoothly and naturally. In addition, flicker which accompanies rewriting of data is less likely to be recognized by a user, whereby eye fatigue of a user can be reduced.

[Eleventh Step]

After a still image is displayed on the display portion of the display unit 120 in the eighth step (S-8), the operation proceeds to the eleventh step (S-11).

In the eleventh step (S-11), the refresh rate of display on the display portion of the display unit 120 is set to a second refresh rate.

The second refresh rate is set to a value lower than the first refresh rate. For example, the second refresh rate can be higher than or equal to $1.16\times10^{-5}$ Hz (about once per day) and lower than or equal to 1 Hz, higher than or equal to $2.78\times10^{-4}$ Hz (about once per hour) and lower than or equal to 0.5 Hz, or higher than or equal to $1.67\times10^{-2}$ Hz (about once per hour) and lower than or equal to 0.1 Hz.

When frequency of rewriting an image is reduced by setting the second refresh rate to an extremely low value, display substantially without flicker can be achieved, and eye fatigue of a user can be effectively reduced.

Further, in a period during which display is performed at the second refresh rate, the frequency of rewriting an image is extremely low; thus, power consumption caused by driving of the display unit 120 can be reduced. In a period during which rewriting operation is not performed, power consumption of part of driver circuits in the display unit 120 can be substantially zero.

As described above, a moving image is displayed at a high refresh rate, and a still image is displayed at an extremely low refresh rate, whereby eye fatigue of a user can be effectively reduced. Thus, with use of such a driving method, eye-friendly display can be achieved.

[Eye Fatigue]

Eye fatigue (eye strain) of a user is roughly classified into two types, nervous fatigue and muscular fatigue.

Nervous fatigue is caused by keeping looking at lighting or flashing for a long time because the retina or the nerve of an eye or the brain is stimulated by the light. A stimulus to a nerve or the brain might adversely affect the circadian rhythm.

Muscular fatigue is caused by heavy use of the ciliary muscle, which is used for focusing the eye on an object (adjusting focus). It is known that the closest distance at which an eye is focused on an object is lengthened owing to muscular fatigue.

Figure 4A:
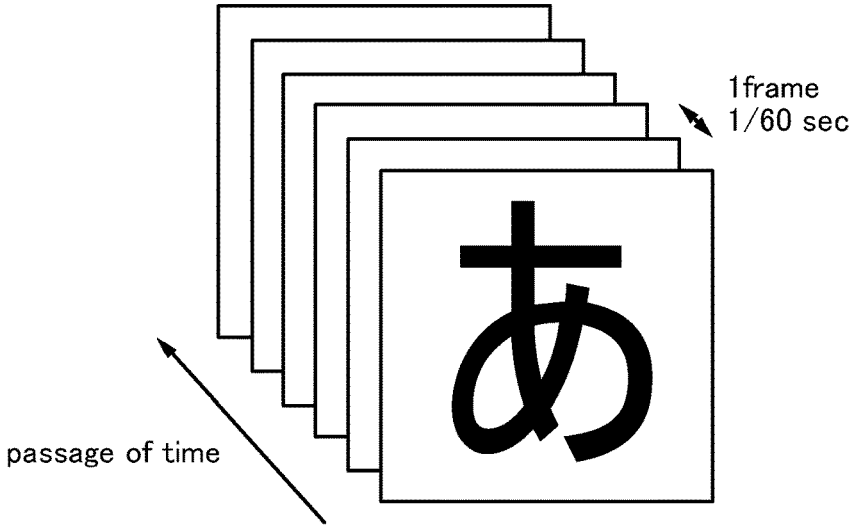
FIGS. 4A and 4B illustrate examples of display on display portions according to Embodiment.

FIG. 4A is a schematic view showing display on a conventional display portion. As shown in FIG. 4A, an image is rewritten 60 times per second in the display on the conventional display portion. The retina or the nerve of an eye or the brain of a user is stimulated by keeping looking at such a screen for a long time and thus eye fatigue might be caused.

In one embodiment of the present invention, a transistor including an oxide semiconductor, for example, a transistor including a c-axis aligned crystalline oxide semiconductor (CAAC-OS), can be used in a pixel portion of a display portion, which is described later. Since the off-state current of a transistor including an oxide semiconductor is extremely low, the luminance of the display portion can be maintained even with frame frequency lowered.

Figure 4B:
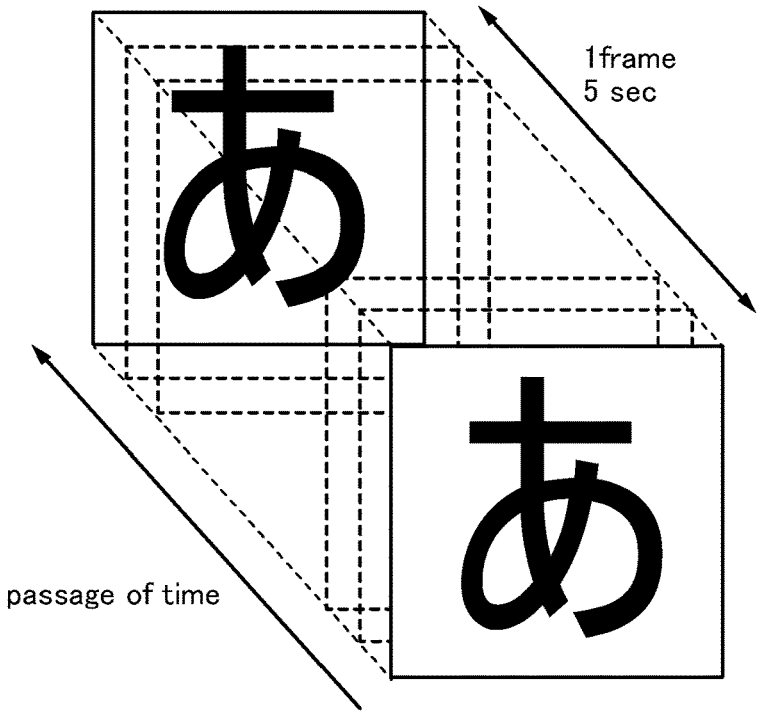

That is, as shown in FIG. 4B, an image can be rewritten as less frequently as once every five seconds, for example. This enables the user to see the same one image as long as possible, so that flicker on the screen recognized by the user is reduced. Consequently, a stimulus to the retina or the nerve of an eye or the brain of the user is relieved, resulting in less nervous fatigue.

Figure 5A:
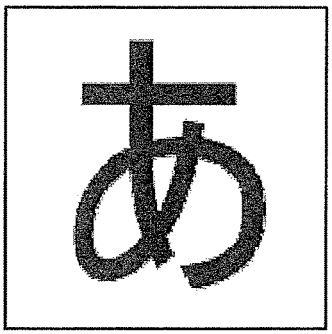
FIGS. 5A and 5B illustrate examples of display on display portions according to Embodiment.

In addition, as shown in FIG. 5A, when the size of each pixel is large (for example, when the resolution is less than 150 ppi), a character displayed on the display portion is blurred. When a user keeps looking at a blurred character displayed on the display portion for a long time, it continues to be difficult to focus the eye on the character even though the ciliary muscle constantly moves in order to focus the eye, which might put strain on the eye.

Figure 5B:
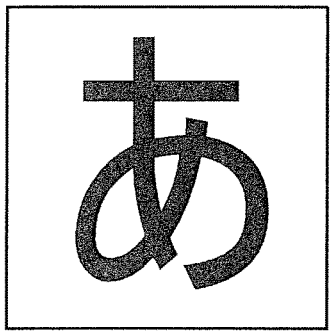

In contrast, as shown in FIG. 5B, a display portion of one embodiment of the present invention is capable of high-resolution display because the size of each pixel is small; thus, smooth, high-resolution images can be displayed. In this case, the ciliary muscle can easily focus the eye on the character, so that the user's muscular fatigue is reduced. When the resolution of the display portion is 150 ppi or more, preferably 200 ppi or more, the user's muscular fatigue can be effectively reduced.

Methods for quantifying eye fatigue have been studied. For example, critical flicker (fusion) frequency (CFF) is known as an indicator for evaluating nervous fatigue. Further, focus adjustment time, near point distance, and the like are known as indicators for evaluating muscular fatigue.

Others methods for evaluating eye fatigue include electroencephalography, thermography, counting the number of times of blinking, measuring the amount of tears, measuring the speed of contractile response of the pupil, and questionnaires for surveying subjective symptoms.

According to evaluation from the above various methods, use of a method for driving an information processing device of one embodiment of the present invention enables reduction in eye fatigue and eye-friendly display as compared with use of the conventional driving method.

[Display Example]

Examples of display methods which can be achieved by the method for driving an information processing device of one embodiment of the present invention are described below with reference to drawings.

[Display Example of Image Information]

An example of displaying two images including different image data by being transferred is described below.

Figure 6A:
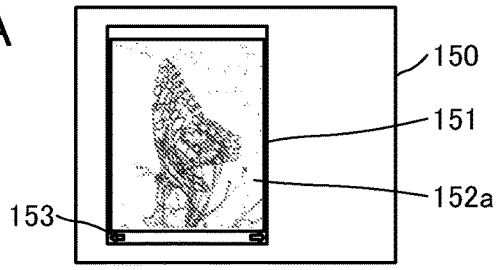
FIGS. 6A to 6E illustrate an example of a method for displaying images on a display portion according to Embodiment.

FIG. 6A illustrates an example in which a window 151 and a first image 152*a* which is a still image displayed in the window 151 are displayed on a display portion 150.

At this time, display is preferably performed at the second refresh rate.

The window 151 is displayed on the display portion 150 by, for example, executing application software for image display and includes a display region where an image is displayed.

Further, in a lower part of the window 151, a button 153 for switching a displayed image data to a different image data is provided. When a user performs operation in which the button 153 is selected with the input unit, an instruction of transferring an image can be supplied to the information processing device.

Note that the operation method performed by the user may be set in accordance with the input unit. For example, in the case where a touch panel provided to overlap with the display portion 150 is used as the input unit, input operation can be performed by touching the button 153 with a finger or a stylus or performing gesture operation where an image displayed on the window 151 is made to slide. In the case where the input operation is performed with gesture or sound, the button 153 is not necessarily displayed.

Figure 6B:
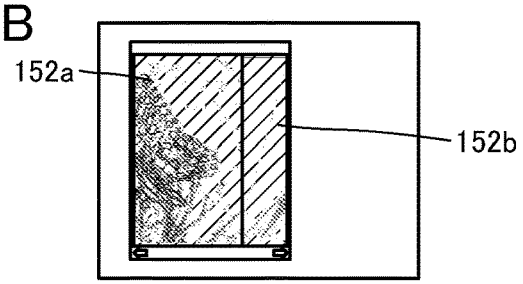

When the information processing device receives the instruction of transferring an image, transfer of the image displayed in the window 151 starts (see FIG. 6B).

Note that in the case where display is performed at the second refresh rate in the state of FIG. 6A, the refresh rate is changed to the first refresh rate before transfer of the image starts.

At this time, an image where the first image 152*a* and a second image 152*b* that is to be displayed next are combined is displayed in the window 151. The combined image is transferred unidirectionally (leftward in this case), and part of the first image 152*a* and part of the second image 152*b* are displayed in the window 151.

Further, when the combined image transfers, luminance of the image displayed in the window 151 is gradually lowered from the initial luminance at the time of the state in FIG. 6A.

Figure 6C:
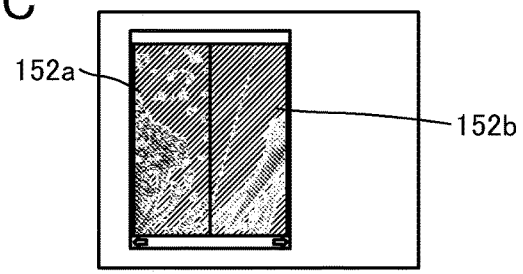

FIG. 6C illustrates a state where the image displayed in the window 151 reaches a position of the predetermined coordinates. Thus, the luminance of the image displayed in the window 151 at this time is lowest.

Note that the predetermined coordinates in FIG. 6C is set so that half of the first image 152*a* and half of the second image 152*b* are displayed; however, the coordinates are not limited to the above, and it is preferable that the coordinates be set freely by a user.

For example, the predetermined coordinates may be set so that the ratio of the distance between the initial coordinates and the predetermined coordinates to the distance between the initial coordinates and the final coordinates is higher than 0 and lower than 1.

In addition, it is also preferable that luminance when the image reaches the position of the predetermined coordinates be set freely by a user. For example, the ratio of the luminance when the image reaches the position of the predetermined coordinates to the initial luminance may be higher than 0 and lower than 1, preferably higher than or equal to 0 and lower than or equal to 0.8, further preferably higher than or equal to 0 and lower than or equal to 0.5.

Figure 6D:
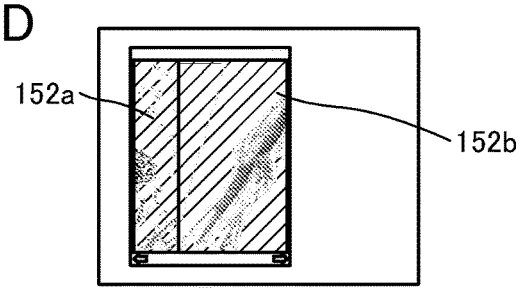

Next, in the window 151, the combined image transfers with the luminance increasing gradually (FIG. 6D)

Figure 6E:
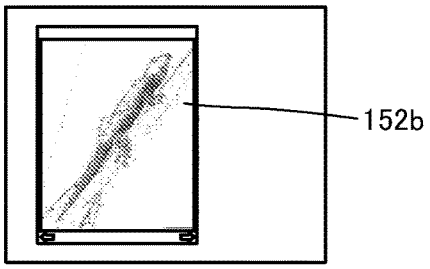

FIG. 6E illustrates a state when the combined image reaches the position of the final coordinates. In the window 151, only the second image 152*b* is displayed with luminance equal to the initial luminance.

Note that after the transfer of the image is completed, the refresh rate is preferably changed to the second refresh rate.

Since the luminance of the image is lowered in such a display mode, even when a user follows the motion of the image with his/her eyes, the user is less likely to suffer from eye fatigue. Thus, with such a driving method, eye-friendly display can be achieved.

[Display Example of Document Information]

An example in which document information whose dimension is larger than a display window is displayed by scrolling is described below.

Figure 7A:
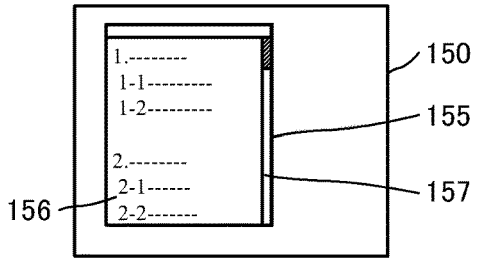
FIGS. 7A to 7E illustrate an example of a method for displaying images on a display portion according to Embodiment.

FIG. 7A illustrates an example in which a window 155 and part of document information 156 which is a still image displayed in the window 155 are displayed on the display portion 150.

At this time, display is preferably performed at the second refresh rate.

The window 155 is displayed by, for example, executing application software for document display, application software for document preparation, or the like and includes a display region where document information is displayed.

The dimension of an image of the document information 156 is larger than the display region of the window 155 in the longitudinally direction. That is, part of the document information 156 is displayed in the window 155. Further, as illustrated in FIG. 7A, the window 155 may be provided with a scroll bar 157 which indicates which part in the whole of the document information 156 is displayed.

Figure 7B:
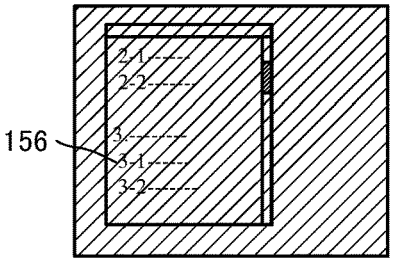

When an instruction of transferring an image (here, also referred to as scroll instruction) is supplied to the information processing device by the input unit, transfer of the document information 156 starts (FIG. 7B). In addition, luminance of the displayed image is gradually lowered.

Note that in the case where display is performed at the second refresh rate in the state of FIG. 7A, the refresh rate is changed to the first refresh rate before transfer of the document information 156.

In this state, not only the luminance of the image displayed in the window 155 but the luminance of the whole image displayed on the display portion 150 is lowered.

Figure 7C:
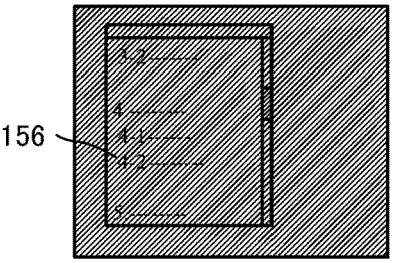

FIG. 7C illustrates a state when the document information 156 reaches a position of the predetermined coordinates. At this time, the luminance of the whole image displayed on the display portion 150 is the lowest.

Figure 7D:
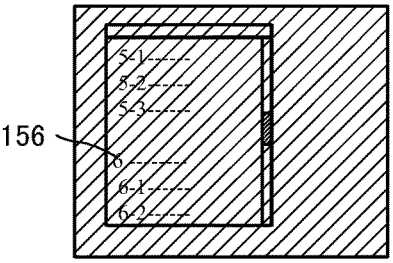

Then, the document information 156 is displayed in the window 155 while being transferred (FIG. 7D). Under this condition, the luminance of the whole image displayed on the display portion 150 is gradually increased.

Figure 7E:
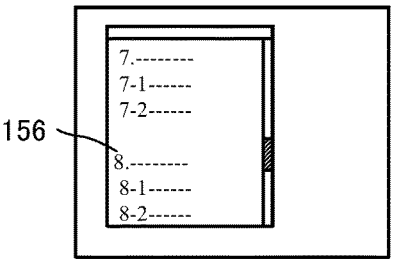

FIG. 7E illustrates a state where the document information 156 reaches a position of the final coordinates. In the window 155, a region of the document information 156, which is different from the region displayed in an initial state, is displayed with luminance equal to the initial luminance.

Note that after transfer of the document information 156 is completed, the refresh rate is preferably changed to the second refresh rate.

Since the luminance of the image is lowered in such a display mode, even when a user follows the motion of the image with his/her eyes, the user can be less likely to suffer from eye fatigue. Thus, with such a driving method, eye-friendly display can be achieved.

In particular, display of document information or the like, which has relatively high contrast ratio, gives a user eye fatigue significantly; thus, it is preferable to apply such a driving method to the display of document information.

This embodiment can be combined with any of the other embodiments disclosed in this specification as appropriate.

(Embodiment 2)

In this embodiment, an example of the information processing device described in Embodiment 1 will be described with reference to FIG. 8 and FIGS. 9A and 9B.

Specifically, the information processing device having a first mode and a second mode is described. In the first mode, G signals selecting pixels are output at a frequency higher than or equal to 30 Hz (30 times per seconds), preferably higher than or equal to 60 Hz (60 times per seconds) and lower than or equal to 960 Hz (960 times per seconds). In the second mode, the G signals are output at a frequency higher than or equal to $1.16\times10^{-5}$ Hz (about once per day) and lower than or equal to 1 Hz, higher than or equal to $2.78\times10^{-4}$ Hz (about once per hour) and lower than or equal to 0.5 Hz, or higher than or equal to $1.67\times10^{-2}$ Hz (about once per minute) and lower than or equal to 0.1.

Figure 8:
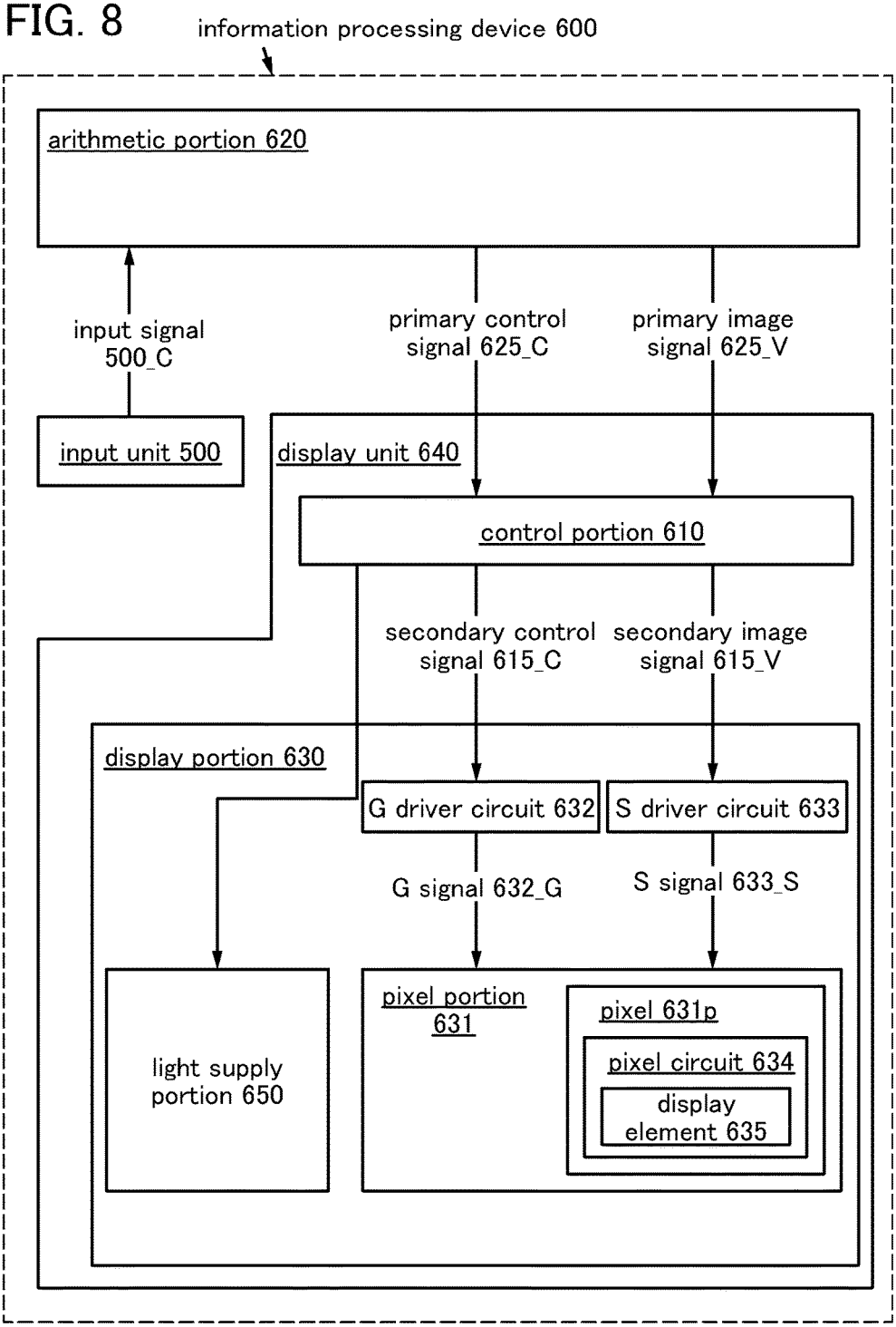
FIG. 8 illustrates a structure example of an information processing device according to Embodiment.

FIG. 8 is a block diagram illustrating a structure of the information processing device having a display function of one embodiment of the present invention.

Figure 9A:
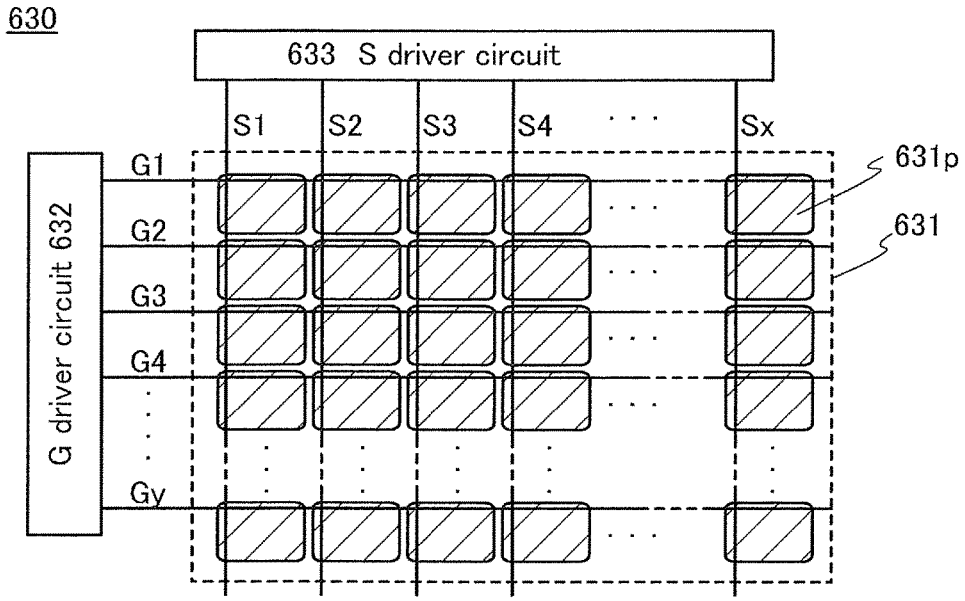
FIGS. 9A and 9B illustrate a configuration example of a display portion of an information processing device according to Embodiment.
Figure 9B:
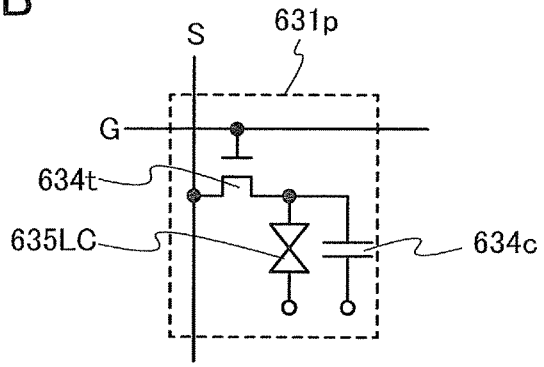

FIGS. 9A and 9B are a block diagram and a circuit diagram illustrating a structure of a display portion in the information processing device having a display function of one embodiment of the present invention.

[1. Structure of Information Processing Device]

In this embodiment, an information processing device 600 having a display function described with FIG. 8 includes a pixel portion 631, pixel circuits 634 which hold first driving signals (also referred to as S signals) 633_S inputted and include display elements 635 displaying an image on the pixel portion 631 in accordance with the S signals 633_S, a first driver circuit (also referred to as S driver circuit) 633 which outputs the S signals 633_S to the pixel circuits 634, and a second driver circuit (also referred to as G driver circuit) 632 which outputs second driving signals (also referred to as G signals) 632_G for selecting the pixel circuits 634 to the pixel circuits 634.

The G driver circuit 632 has a first mode where the G signals 632_G are output to the pixels at a frequency higher than or equal to 30 times per second, preferably higher than or equal to 60 times per second and lower than or equal to 960 times per second, and a second mode where the G signals 632_G are output to the pixels at a frequency higher than or equal to once per day and lower than or equal to 1 times per second, preferably higher than or equal to once per hour and lower than or equal to once per second.

Note that the G driver circuit 632 is switched between the first mode and the second mode in response to a mode switching signal(s) which is/are input.

The pixel circuit 634 is provided in a pixel 631*p*. A plurality of pixels 631*p* are provided in the pixel portion 631 in a display portion 630.

The information processing device 600 having a display function includes an arithmetic portion 620. The arithmetic portion 620 outputs primary control signals 625_C and primary image signals 625_V.

A display unit 640 includes the display portion 630 and a control portion 610. The control portion 610 controls the S driver circuit 633 and the G driver circuit 632.

In the case where a liquid crystal element is used as the display element 635, the display portion 630 is provided with a light supply portion 650. The light supply portion 650 supplies light to the pixel portion 631 including liquid crystal elements and functions as a backlight.

In the information processing device 600 having a display function, the frequency of selecting one pixel circuit from the plurality of pixel circuits 634 in the pixel portion 631 can be changed by the G signals 632_G outputted from the G driver circuit 632. Consequently, an information processing device having a display function which is less likely to cause eye fatigue of a user can be provided as the information processing device 600.

Although the block diagram attached to this specification shows components classified by their functions in independent blocks, it is difficult to classify actual components according to their functions completely and it is possible for one component to have a plurality of functions.

In this specification, the terms "source" and "drain" of a transistor interchange with each other depending on the polarity of the transistor or the levels of potentials applied to the terminals. In general, in an n-channel transistor, a terminal to which a lower potential is applied is called a source, and a terminal to which a higher potential is applied is called a drain. Further, in a p-channel transistor, a terminal to which a lower potential is applied is called a drain, and a terminal to which a higher potential is applied is called a source. In this specification, although connection relation of the transistor is described assuming that the source and the drain are fixed in some cases for convenience, actually, the names of the source and the drain interchange with each other depending on the relation of the potentials.

Note that in this specification, a "source" of a transistor means a source region that is part of a semiconductor film functioning as an active layer or a source electrode connected to the semiconductor film. Similarly, a "drain" of a transistor means a drain region that is part of the semiconductor film or a drain electrode connected to the semiconductor film. A "gate" means a gate electrode.

Note that in this specification, a state in which transistors are connected to each other in series means, for example, a state in which only one of a source and a drain of a first transistor is connected to only one of a source and a drain of a second transistor. In addition, a state in which transistors are connected in parallel with each other means a state in which one of a source and a drain of a first transistor is connected to one of a source and a drain of a second transistor and the other of the source and the drain of the first transistor is connected to the other of the source and the drain of the second transistor.

In this specification, the term "connection" means electrical connection and corresponds to a state where current, voltage, or a potential can be supplied or transmitted. Accordingly, a connection state means not only a state of a direct connection but also a state of indirect connection through a circuit element such as a wiring, a resistor, a diode, or a transistor so that current, a potential, or voltage can be supplied or transmitted.

In this specification, even when different components are connected to each other in a circuit diagram, there is actually a case where one conductive film has functions of a plurality of components such as a case where part of a wiring serves as an electrode. The term "connection" also means such a case where one conductive film has functions of a plurality of components.

The following describes individual components included in the information processing device having a display function of one embodiment of the present invention.

[2. Arithmetic Portion]

The arithmetic portion 620 generates the primary control signals 625_C and the primary image signals 625_V.

In addition, the arithmetic portion 620 generates the primary control signals 625_C including a mode switching signal(s).

For example, the arithmetic portion 620 may output the primary control signals 625_C including a mode switching signal(s) in accordance with input signals 500_C inputted from an input unit 500.

When input signals 500_C are input to the G driver circuit 632 in the second mode through the control portion 610 from the input unit 500, the G driver circuit 632 is switched from the second mode to the first mode, outputs the G signal at least once, and then being switched to the second mode.

For example, in the case where the input unit 500 detects operation of transferring an image, the input unit 500 outputs the input signals 500_C to the arithmetic portion 620.

The arithmetic portion 620 generates the primary image signals 625_V including the image transferring operation and outputs the primary image signals 625_V together with the primary control signals 625_C including the input signals 500_C.

The control portion 610 outputs the input signals 500_C to the G driver circuit 632 and outputs secondary image signals 615_V including image transferring operation to the S driver circuit 633.

The G driver circuit 632 is switched from the second mode to the first mode, and the G signals 632_G are rewritten with speed at which a user cannot notice the change of images which occurs every signal rewriting.

Meanwhile, the S driver circuit 633 outputs to the pixel circuits 634 the S signals 633_S generated from the secondary image signals 615_V including the image transferring operation.

Thus, the pixels 631*p* can display a large number of frame images including image transferring operation in a short period of time, and accordingly the secondary image signals 615_V including smooth image transferring operation can be displayed.

Alternatively, the following structure may be employed: the arithmetic portion 620 determines whether an image based on the primary image signals 625_V to be output to the display portion 630 is a moving image or a still image, and the arithmetic portion 620 outputs a switching signal selecting the first mode when the image based on the primary image signals 625_V is a moving image and outputs a switching signal selecting the second mode when the image based on the image primary signals 625_V is a still image.

An example of a method for determining whether the image based on the primary image signals is a moving image or a still image is as follows. Signals for one frame included in the primary image signals 625_V are compared with signals for the pervious frame and signals for the next frame, whereby differences are obtained. It is determined that the image is a moving image when the differences are each greater than a predetermined difference, and it is determined that the image is a still image in other cases.

Further, a structure may be employed in which when the G driver circuit 632 is switched from the second mode to the first mode, the G driver circuit 632 outputs the G signals 632_G predetermined times, which is once or more times, then being switched to the second mode.

[3. Control Portion]

The control portion 610 outputs the secondary image signals 615_V generated from the primary image signals 625_V (see FIG. 8). Note that the primary image signals 625_V may be directly input to the display portion 630.

The control portion 610 has function of generating secondary control signals 615_C such as a start pulse signal SP, a latch signal LP, and a pulse width control signal PWC by using the primary control signals 625_C such as a vertical synchronization signal or a horizontal synchronization signal and supplying the control signals to the display portion 630. The secondary control signals 615_C include a clock signal CK and the like.

Further, the control portion 610 is provided with an inversion control circuit to have a function of inverting the polarity of the secondary image signal 615_V at a timing notified by the inversion control circuit. Specifically, the polarity of the secondary image signal 615_V may be inverted in the control portion 610, or may be inverted in the display portion 630 in accordance with an instruction from the control portion 610.

The inversion control circuit has a function of determining timing of inverting the polarity of the secondary image signal 615_V by using a synchronization signal. For example, the inversion control circuit includes a counter and a signal generation circuit.

The counter has a function of counting the number of frame periods by using the pulse of a horizontal synchronizing signal.

The signal generation circuit has a function of notifying timing of inverting the polarity of the secondary image signal 615_V to the control portion 610 so that the polarity of the secondary image signal 615_V is inverted every plural consecutive frame periods by using information on the number of frame periods that is obtained in the counter.

[4. Display Portion]

The display portion 630 includes the pixel portion 631 including a display element 635 in each pixel and driver circuits such as the S driver circuit 633 and the G driver circuit 632. The pixel portion 631 includes the plurality of pixels 631*p* each provided with the display element 635 (see FIG. 8).

The secondary image signals 615_V that are input to the display portion 630 are supplied to the S driver circuit 633. In addition, power supply potentials and the secondary control signals 615_C are supplied to the S driver circuit 633 and the G driver circuit 632.

Note that the control signals 615_C include an S driver circuit start pulse signal SP and an S driver circuit clock signal CK that control the operation of the S driver circuit 633; a latch signal LP; a G driver circuit start pulse SP and a G driver circuit clock signal CK that control the operation of the G driver circuit 632; a pulse width control signal PWC; and the like.

FIG. 9A illustrates an example of a structure of the display portion 630.

In the display portion 630 in FIG. 9A, the plurality of pixels 631*p*, a plurality of scan lines G for selecting the pixels 631*p* row by row, and a plurality of signal lines S for supplying the S signals 633_S generated from the secondary image signals 615_V to the selected pixels 631*p* are provided in the pixel portion 631.

The input of the G signals 632_G to the scan lines G is controlled by the G driver circuit 632. The input of the S signals 633_S to the signal lines S is controlled by the S driver circuit 633. Each of the plurality of pixels 631*p* is connected to at least one of the scan lines G and at least one of the signal lines S.

Note that the kinds and number of the wirings in the pixel portion 631 can be determined by the structure, number, and position of the pixels 631*p*. Specifically, in the pixel portion 631 illustrated in FIG. 9A, the pixels 631*p* are arranged in a matrix of x columns and y rows, and the signal lines S1 to Sx and the scan lines G1 to Gy are provided in the pixel portion 631.

[4-1. Pixel]

Each pixel 631*p* includes the display element 635 and the pixel circuit 634 including the display element 635.

[4-2. Pixel Circuit]

In this embodiment, a structure in which a liquid crystal element 635LC is used as the display element 635 is illustrated as an example of the pixel circuit 634 in FIG. 9B.

The pixel circuit 634 includes a transistor 634*t* for controlling supply of the S signal 633_S to the liquid crystal element 635LC. An example of connection relation between the transistor 634*t* and the display element 635 will be described.

A gate of the transistor 634*t* is connected to any one of the scan lines G1 to Gy. One of a source and a drain of the transistor 634*t* is connected to any one of the signal lines S1 to Sx. The other of the source and the drain of the transistor 634*t* is connected to a first electrode of the display element 635.

Note that the pixel 631*p* may further include a capacitor 634*c* for holding voltage between the first electrode and a second electrode of the liquid crystal element 635LC and another circuit element such as a transistor, a diode, a resistor, a capacitor, or an inductor as needed.

In the pixel 631*p* illustrated in FIG. 9B, one transistor 634*t* is used as a switching element controlling input of the S signal 633_S to the pixel 631*p*; however, a plurality of transistors functioning as one switching element may be used in the pixel 631*p*. In the case where a plurality of transistors functions as one switching element, the plurality of transistors may be connected to each other in parallel, in series, or in combination of parallel connection and series connection.

Note that the size of the capacitance of the capacitor 634*c* can be adjusted as appropriate. For example, in the case where the S signal 633_S is held for a relatively long period (specifically, 1/60 sec or more) in the second mode, the capacitor 634*c* is provided. It is also possible to adjust the capacitance of the pixel circuit 634 with use of a component other than the capacitor 634*c*. For example, the first electrode and the second electrode of the liquid crystal element 635LC may be overlapped with each other to substantially form a capacitor.

Note that the structure of the pixel circuit 634 can be selected in accordance with the kind or the driving method of the display element 635.

[4-2a. Display Element]

The liquid crystal element 635LC includes the first electrode, the second electrode, and a liquid crystal layer including a liquid crystal material to which the voltage between the first electrode and the second electrode is applied. In the liquid crystal element 635LC, the alignment of liquid crystal molecules is changed in accordance with the level of voltage applied between the first electrode and the second electrode, so that the transmittance is changed. Accordingly, the transmittance of the display element 635 is controlled by the potential of the S signal 633_S; thus, gradation can be expressed.

Note that, besides the liquid crystal element 635LC, any of a variety of display elements such as an OLED element generating luminescence (electroluminescence) when an electric field is applied thereto and electronic ink utilizing electrophoresis can be used as the display element 635.

[4-2b. Transistor]

The transistor 634*t* controls whether to apply the potential of the signal line S to the first electrode of the display element 635. A predetermined reference potential Vcom is applied to the second electrode of the display element 635.

Note that a transistor including an oxide semiconductor can be suitably used for an information processing device having a display function which can be driven by the method for driving an information processing device having a display function of one embodiment of the present invention. For details of the transistor including an oxide semiconductor, Embodiment 2 can be referred to.

[5. Light Supply Portion]

A plurality of light sources are provided in the light supply portion 650. The control portion 610 controls driving of the light sources in the light supply portion 650.

The light source in the light supply portion 650 can be a cold cathode fluorescent lamp, a light-emitting diode (LED), an OLED element generating luminescence (electroluminescence) when an electric field is applied thereto, or the like.

Figure 21:
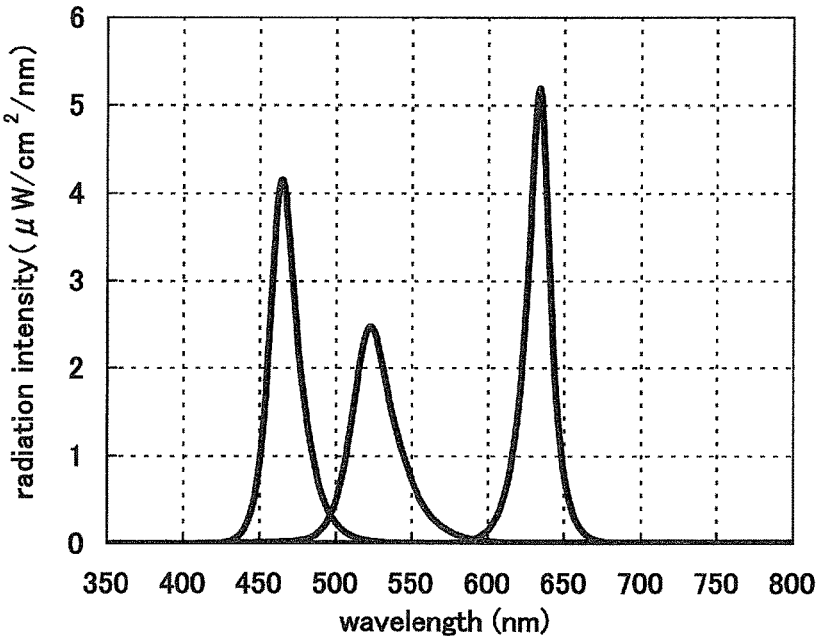
FIG. 21 shows an example of emission spectra of light from a backlight according to Embodiment.

In particular, the intensity of blue light emitted by the light source is preferably weakened compared to that of light of any other color. Blue light included in light emitted by the light source reaches the retina of the eye without being absorbed by the cornea or the lens. Accordingly, it is possible to reduce long-term effects of blue light on the retina (e.g., age-related macular degeneration), adverse effects of exposure to blue light until midnight on the circadian rhythm, and the like. In addition, a light source emitting light that mainly includes light with a wavelength longer than 400 nm and does not include light with a wavelength shorter than or equal to 400 nm (also referred to as UVA) is preferred. Furthermore, it is preferable to use a light source emitting light that mainly includes light with a wavelength longer than 440 nm and does not include light with a wavelength shorter than or equal to 440 nm, and further preferable to use a light source emitting light that includes light with a wavelength longer than 420 nm and does not include light with a wavelength shorter than or equal to 420 nm In FIG. 21, preferred spectra of light emitted from the backlight are shown. FIG. 21 shows an example of spectra of light emitted from light-emitting diodes (LED) which are used as light sources of the backlights of three colors, red (R), green (G), and blue (B). In FIG. 21, in the range where the wavelength is shorter than or equal to 420 nm, the radiation intensity is hardly observed. With use of a display portion using such a light source as a backlight, eye fatigue of a user is less caused.

[6. Input Unit]

As the input unit 500, a variety of human interface devices such as a touch panel, a touch pad, a mouse, a keyboard, a joystick, a trackball, a data glove, and an imaging device can be used. By the arithmetic portion 620, electric signals inputted from the input unit 500 can be associated with coordinates of the display portion. Thus, an instruction for processing data displayed on the display portion can be input by the user.

Examples of data that is input from the input unit 500 by the user include an instruction of dragging an image to change a position of the image that is displayed on the display portion, an instruction of swiping a displayed image to transfer the image so as to display a next image, an instruction of scrolling images to transfer the images sequentially, an instruction of selecting a specific image, an instruction of pinching operation to change a size of a displayed image, and an instruction of inputting handwritten characters.

The method for driving an information processing device described in Embodiment 1 is applied to the information processing device described in this embodiment and a program for driving the information processing device described in Embodiment 1 is executed by the arithmetic portion, whereby eye fatigue of a user can be suppressed, and eye-friendly display can be performed by the display unit.

This embodiment can be combined with any of the other embodiments disclosed in this specification as appropriate.

(Embodiment 3)

Figure 10:
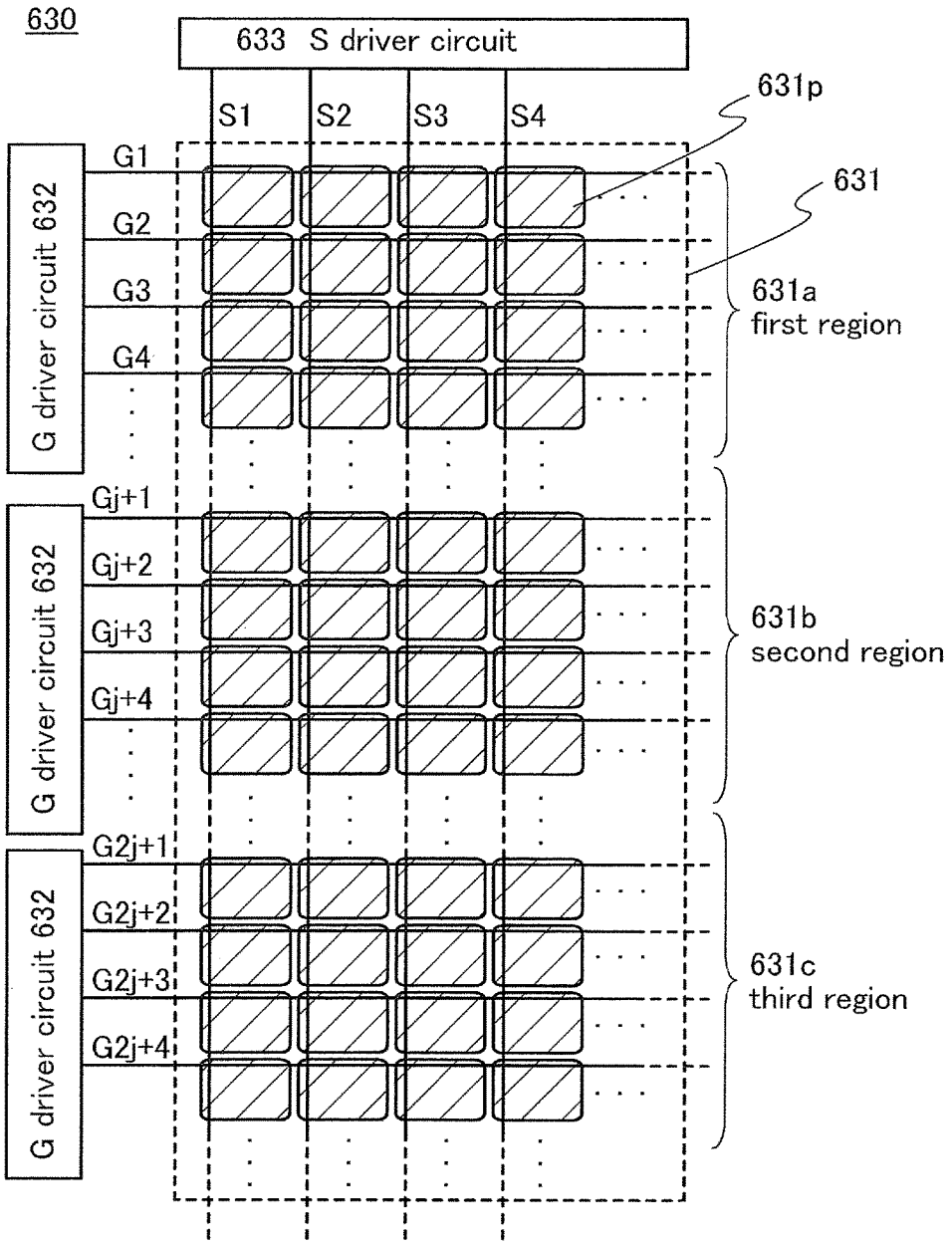
FIG. 10 illustrates a configuration example of a display portion of an information processing device according to Embodiment.
Figure 11:
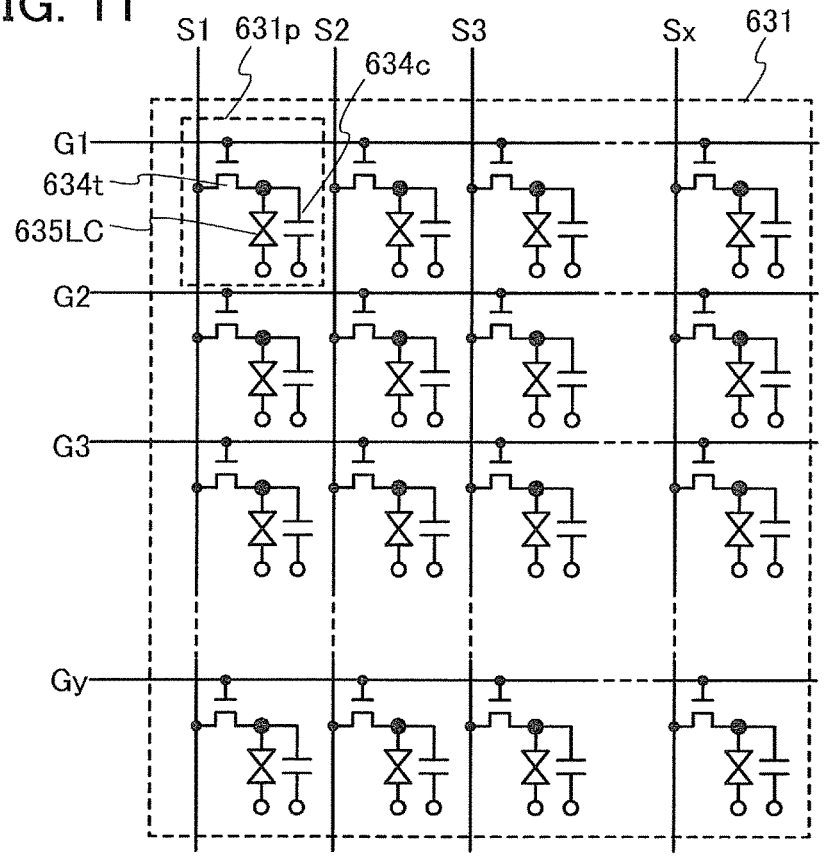
FIG. 11 illustrates a configuration example of an information processing device according to Embodiment.

In this embodiment, an example of a method for driving the information processing device described in Embodiment 2 will be described with reference to FIGS. 9A and 9B. FIG. 10, and FIG. 11.

Specifically, a method for driving an information processing device having a first mode and a second mode is described. In the first mode, G signals selecting pixels are output at a frequency higher than or equal to 30 Hz (30 times per seconds), preferably higher than or equal to 60 Hz (60 times per seconds) and lower than or equal to 960 Hz (960 times per seconds). In the second mode, the G signals are output at a frequency higher than or equal to $1.16\times10^{-5}$ Hz (about once per day) and lower than or equal to 1 Hz, higher than or equal to $2.78\times10^{-4}$ Hz (about once per hour) and lower than or equal to 0.5 Hz, or higher than or equal to $1.67\times10^{-2}$ Hz (about once per minute) and lower than or equal to 0.1.

FIGS. 9A and 9B are a block diagram and a circuit diagram illustrating a structure of a display portion which can be applied to a display unit in the information processing device having a display function of one embodiment of the present invention.

FIG. 10 is a block diagram illustrating a modification example of a structure of a display portion which can be applied to a display unit in the information processing device having a display function of one embodiment of the present invention.

FIG. 11 is a circuit diagram showing a configuration example of a display portion which can be applied to a display unit in the information processing device having a display function of one embodiment of the present invention.

[1. Method for Writing S Signal into Pixel Portion]

An example of a method for writing S signals 633_S into the pixel portion 631 in FIG. 9A or FIG. 10 is described. Specifically, a method for writing S signals 633_S into each pixel 631*p* including the pixel circuit illustrated in FIG. 9B in the pixel portion 631 is described.

[Writing Signals into Pixel Portion]

In a first frame period, the scan line G1 is selected by input of the G signal 632_G with a pulse to the scan line G1. In each of the plurality of pixels 631*p* connected to the selected scan line G1, the transistor 634*t* is turned on.

When the transistors 634*t* are on (in one line period), the potentials of the S signals 633_S generated from the secondary image signals 615_V are applied to the signal lines S1 to Sx. Through each of the transistors 634*t* that are on, charge corresponding to the potential of the S signal 633_S is accumulated in the capacitor 634*c* and the potential of the S signal 633_S is applied to the first electrode of the liquid crystal element 635LC.

In a period during which the scan line G1 is selected in the first frame period, the S signals 633_S having a positive polarity are sequentially input to all the signal lines S1 to Sx. Thus, the S signals 633_S having a positive polarity are input to first electrodes G1S1 to G1Sx in the pixels 631*p* that are connected to the scan line G1 and the signal lines S1 to Sx. The transmittance of the liquid crystal element 635LC is controlled by the potential of the S signal 633_S; thus, gradation is expressed by the pixels.

Similarly, the scan lines G2 to Gy are sequentially selected, and the pixels 631*p* connected to the scan lines G2 to Gy are sequentially subjected to the same operation as that performed while the scan line G1 is selected. Through the above operations, an image for the first frame can be displayed on the pixel portion 631.

Note that, in one embodiment of the present invention, the scan lines G1 to Gy are not necessarily selected in sequence.

It is possible to employ dot sequential driving in which the S signals 633_S are sequentially input to the signal lines S1 to Sx from the S driver circuit 633 or line sequential driving in which the S signals 633_S are input all at once. Alternatively, a driving method in which the S signals 633_S are sequentially input to every plural signal lines S may be employed.

In addition, the method for selecting the scan lines G is not limited to progressive scan; interlaced scan may be employed for selecting the scan lines G In given one frame period, the polarities of the S signals 633_S input to all the signal lines may be the same, or the polarities of the S signals 633_S to be input to the pixels may be inverted signal line by signal line.

[Writing Signal into Pixel Portion Divided into Plural Regions]

FIG. 10 illustrates a modification example of the structure of the display portion 630.

In the display portion 630 in FIG. 10, the plurality of pixels 631*p*, the plurality of scan lines G for selecting the pixels 631*p* row by row, and the plurality of signal lines S for supplying the S signals 633_S to the selected pixels 631*p* are provided in the pixel portion 631 divided into plural regions (specifically, a first region 631*a*, a second region 631*b*, and a third region 631*c*).

The input of the G signals 632_G to the scan lines G in each region is controlled by the corresponding G driver circuit 632. The input of the S signals 633_S to the signal lines S is controlled by the S driver circuit 633. Each of the plurality of pixels 631*p* is connected to at least one of the scan lines G and at least one of the signal lines S.

Such a structure allows the pixel portion 631 to be divided into separately driven regions.

For example, the following operation is possible: a touch panel is used as the input unit 500, and when information is input from the touch panel, coordinates specifying a region to which the information is to be input are obtained, and the G driver circuit 632 driving the region corresponding to the coordinates operates in the second mode and the G driver circuit 632 driving the other region operates in the first mode. Thus, it is possible to stop the operation of the G driver circuit for a region where information has not been input from the touch panel, that is, a region where rewriting of a displayed image is not necessary.

[2. G Driver Circuit in First Mode and Second Mode]

The S signal 633_S is input to the pixel circuit 634 to which the G signal 632_G outputted by the G driver circuit 632 is input. In a period during which the G signal 632_G is not input, the pixel circuit 634 holds the potential of the S signal 633_S. In other words, the pixel circuit 634 holds a state where the potential of the S signal 633_S is written in.

The pixel circuit 634 into which display data is written maintains a display state corresponding to the S signal 633_S. Note that to maintain a display state is to keep the amount of change in display state so that the amount of change may not exceed a given range. This given range is set as appropriate, and is preferably set so that a user watching display images recognizes the displayed images as one image.

The G driver circuit 632 has the first mode and the second mode.

[2-1. First Mode]

The G driver circuit 632 in the first mode outputs the G signals 632_G to pixels at a frequency higher than 30 times per second, preferably higher than or equal to 60 times and lower than or equal to 960 times per second.

The G driver circuit 632 in the first mode rewrites signals at a speed such that change in images which occurs each time signals are rewritten is not recognized by the user. As a result, smooth moving images can be displayed.

[2-2. Second Mode]

The G driver circuit 632 in the second mode outputs the G signals 632_G to pixels at a frequency higher than or equal to once per day and lower than or equal to 0.1 times per second, preferably higher than or equal to once per hour and lower than once per second.

In a period during which the G signal 632_G is not input, the pixel circuit 634 keeps holding the S signal 633_S and maintains the display state corresponding to the potential of the S signal 633_S.

In this manner, display without flicker due to rewriting of the display in the pixel can be performed in the second mode.

As a result, eye fatigue of a user of the information processing device can be less caused.

Power consumed by the G driver circuit 632 is reduced in a period during which the G driver circuit 632 does not operate.

Note that the pixel circuit that is driven by the G driver circuit 632 having the second mode is preferably configured to hold the S signal 633_S for a long period. For example, the off-state leakage current of the transistor 634*t* is preferably as low as possible.

Examples of structures of the transistor 634*t* with low off-state leakage current will be described in Embodiment 6 and Embodiment 7.

The method for driving an information processing device described in this embodiment is applied to the method for driving an information processing device described in Embodiment 1 and the program for driving the information processing device described in Embodiment 1, whereby eye fatigue of a user can be suppressed, and eye-friendly display can be performed by the display unit.

This embodiment can be combined with any of the other embodiments disclosed in this specification as appropriate.

(Embodiment 4)

In this embodiment, an example of a semiconductor device having a display function (also referred to as display device) which can be applied to the above-described display unit will be described.

Figure 12B:
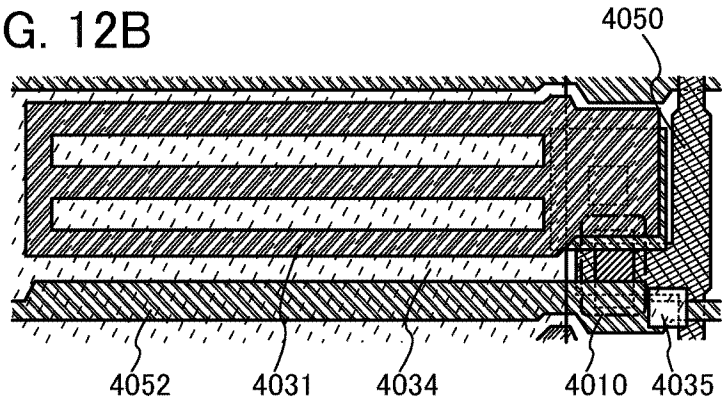
FIGS. 12A to 12C illustrate a structure example of a display device according to Embodiment.
Figure 12A:
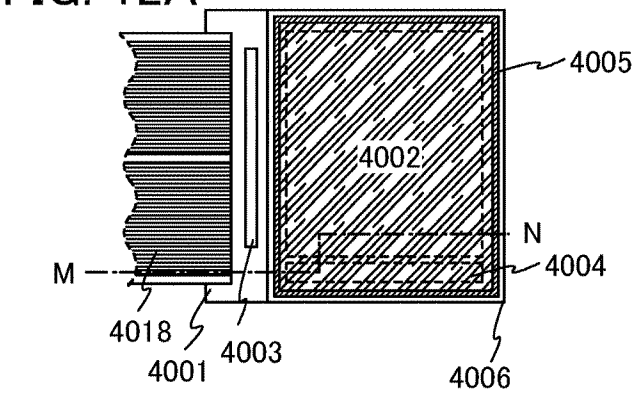

FIG. 12A is a plan view of a display device of this embodiment. In FIG. 12A, a sealant 4005 is provided so as to surround a pixel portion 4002 and a scan line driver circuit 4004 provided over a substrate 4001. The substrate 4006 is provided over the pixel portion 4002 and the scan line driver circuit 4004. Consequently, the pixel portion 4002 and the scan line driver circuit 4004 are sealed together with a display element by the substrate 4001, the sealant 4005, and the substrate 4006. In FIG. 12A, an IC chip or a signal line driver circuit 4003 which is formed using a single crystal semiconductor film or a polycrystalline semiconductor film over a substrate separately prepared is mounted in a region that is different from the region surrounded by the sealant 4005 over the substrate 4001. A variety of signals and potentials which are provided for the pixel portion 4002 through the signal line driver circuit 4003 and the scan line driver circuit 4004 are supplied from a flexible printed circuit (FPC) 4018.

Although FIG. 12A illustrates an example in which the signal line driver circuit 4003 is formed separately and mounted on the first substrate 4001, the present invention is not limited to this structure. The scan line driver circuit may be separately formed and then mounted, or only part of the signal line driver circuit or part of the scan line driver circuit may be separately formed and then mounted.

Note that a connection method of a separately formed driver circuit is not particularly limited, and a chip on glass (COG) method, a wire bonding method, a tape automated bonding (TAB) method, or the like can be used. FIG. 12A illustrates an example in which the signal line driver circuit 4003 is mounted by a COG method.

Note that the display device includes a panel in which the display element is sealed, and a module in which an IC including a controller or the like is mounted on the panel. In other words, the display device in this specification means an image display device or a light source (including a lighting device). Furthermore, the display device also includes the following modules in its category: a module to which a connector such as an FPC or a Tape Carrier Package (TCP) is attached; a module having a TCP at the tip of which a printed wiring board is provided; and a module in which an integrated circuit (IC) is directly mounted on a display element by a COG method.

Further, the pixel portion and the scan line driver circuit provided over the substrate include a plurality of transistors. There is no particular limitation on the structure of the transistor, and a transistor including an oxide semiconductor described in Embodiment 6 is preferably used.

As the display element provided in the display device, a liquid crystal element (also referred to as a liquid crystal display element) or a light-emitting element (also referred to as a light-emitting display element) can be used. The light-emitting element includes an element whose luminance is controlled by current or voltage in its category, and specifically includes an inorganic electroluminescent (EL) element, an organic EL element, and the like. Furthermore, a display medium whose contrast is changed by an electric effect, such as an electronic ink display (electronic paper), can be used.

Figure 12C:
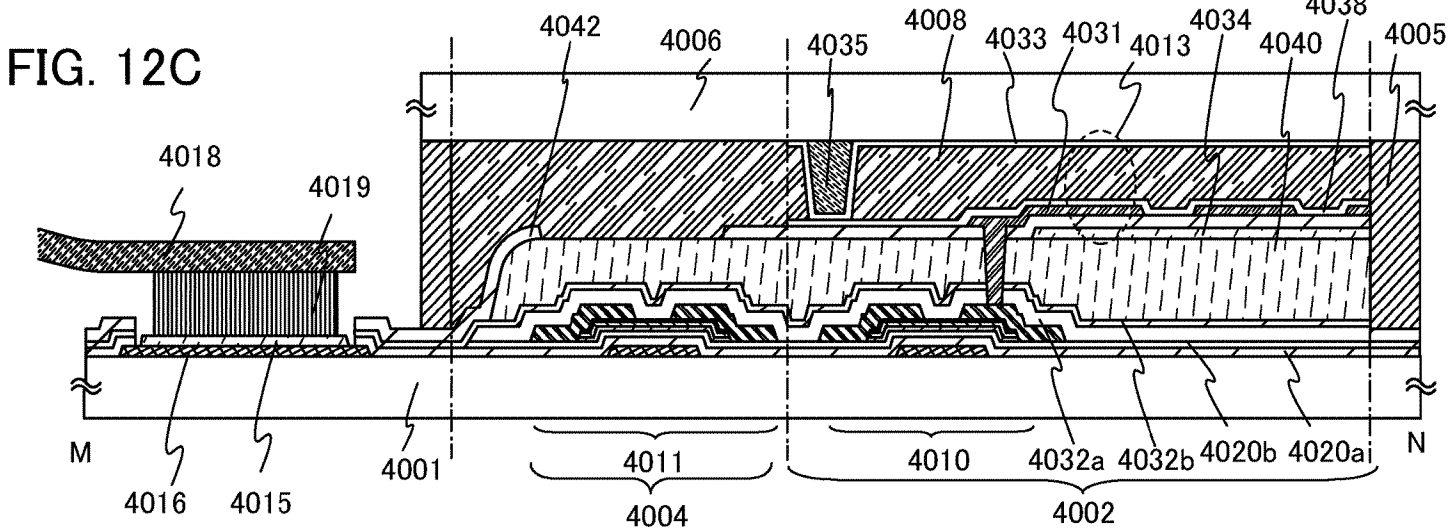

FIG. 12C is a cross-sectional view taken along a line M-N in FIG. 12A. An examples of a liquid crystal display device using a liquid crystal element as a display element is illustrated in FIGS. 12A to 12C. Note that a transistor 4010 provided in the pixel portion 4002 is electrically connected to a display element to form a display panel. A variety of display elements can be used as the display element as long as display can be performed.

A liquid crystal display device can employ a vertical electric field mode or a horizontal electric field mode. FIG. 12C illustrates an example in which a fringe field switching (FFS) mode is employed.

Note that another mode which is different from the above mode can be used for the liquid crystal display device. For example, a vertical alignment (VA) mode, an in-plane-switching (IPS) mode, a twisted nematic (TN) mode, an axially symmetric aligned micro-cell (ASM) mode, an optically compensated birefringence (OCB) mode, a ferroelectric liquid crystal (FLC) mode, an antiferroelectric liquid crystal (AFLC) mode, or the like can be used.

As illustrated in FIGS. 12A and 12C, the semiconductor device includes a connection terminal electrode 4015 and a terminal electrode 4016. The connection terminal electrode 4015 and the terminal electrode 4016 are electrically connected to a terminal included in the FPC 4018 through an anisotropic conductive layer 4019.

The connection terminal electrode 4015 is formed from the same conductive layer as a first electrode layer 4034. The terminal electrode 4016 is formed from the same conductive layer as gate electrode layers of the transistor 4010 and a transistor 4011.

A plurality of transistors are included in the pixel portion 4002 and the scan line driver circuit 4004 which are formed over the first substrate 4001. FIG. 12C illustrates the transistor 4010 included in the pixel portion 4002 and the transistor 4011 included in the scan line driver circuit 4004, and insulating layers 4032*a* and 4032*b* are provided over the transistors 4010 and 4011.

In FIG. 12C, a planarization insulating layer 4040 is provided over the insulating layer 4032*b*, and an insulating layer 4042 is provided between the first electrode layer 4034 and a second electrode layer 4031.

The transistor including an oxide semiconductor in a channel formation region which is described in Embodiment 6 is preferably used for each of the transistors 4010 and 4011. The transistors 4010 and 4011 are bottom-gate transistors.

A gate insulating layer included in the transistors 4010 and 4011 can have a single layer structure or a stacked structure. In this embodiment, the gate insulating layer may have a stacked structure including a gate insulating layers 4020*a* and 4020*b*. In FIG. 12C, the gate insulating layer 4020*a* and the insulating layer 4032*b* extend below the sealant 4005 to cover the end portion of the connection terminal electrode 4015, and the insulating layer 4032*b* covers side surfaces of the gate insulating layer 4020*b* and the insulating layer 4032*a*.

Moreover, a conductive layer may be provided so as to overlap with a channel formation region of the oxide semiconductor layer of the transistor 4011 for the driver circuit. The conductive layer is provided at the position overlapping with the channel formation region of the oxide semiconductor layer, whereby the amount of shift in threshold voltage of the transistor 4011 can be reduced.

The conductive layer also has a function of blocking an external electric field, that is, to prevent an external electric field (particularly, to prevent static electricity) from effecting the inside (a circuit portion including a transistor). A blocking function of the conductive layer can prevent a variation in electrical characteristics of the transistor due to the effect of external electric field such as static electricity.

The planarization insulating layer 4040 can be formed using an organic resin such as, an acrylic resin, a polyimide resin, a benzocyclobutene-based resin, a polyamide resin, or an epoxy resin. Other than such organic materials, a low-dielectric constant material (a low-k material) or a siloxane-based resin can be used. It is preferable that impurities such as water in the planarization insulating layer 4040 be sufficiently reduced. With use of the planarization insulating layer 4040, a variation in electrical characteristics of the transistor can be prevented, and an extremely-highly reliable display device can be achieved.

In FIG. 12C, a liquid crystal element 4013 includes the first electrode layer 4034, the second electrode layer 4031, and a liquid crystal layer 4008. Note that insulating layers 4033 and 4038 functioning as alignment films are provided so that the liquid crystal layer 4008 is interposed therebetween.

As a liquid crystal composition contained in the liquid crystal layer 4008, a thermotropic liquid crystal, a low-molecular liquid crystal, a high-molecular liquid crystal, a polymer-dispersed liquid crystal, a ferroelectric liquid crystal, an anti-ferroelectric liquid crystal, or the like can be used. Moreover, a liquid crystal exhibiting a blue phase is preferably used because an alignment film is not necessary and the viewing angle is wide. It is also possible to use a polymer-stabilized liquid crystal material which is obtained by adding a monomer and a polymerization initiator to the above liquid crystal and, after injection or dispensing and sealing of the liquid crystal, polymerizing the monomer.

In the liquid crystal element 4013, the second electrode layer 4031 having an opening pattern is provided below the liquid crystal layer 4008, and the first electrode layer 4034 having a flat plate shape is provided below the second electrode layer 4031 with the insulating layer 4042 provided therebetween. The second electrode layer 4031 having an opening pattern includes a bent portion or a branched comb-shaped portion. The provision of the opening pattern for the second electrode layer 4031 enables an electric field to be generated between electrodes of the first electrode layer 4034 and the second electrode layer 4031. Note that a structure may be employed in which the second electrode layer 4031 having a flat plate shape is formed on and in contact with the planarization insulating layer 4040, and the first electrode layer 4034 having an opening pattern and serving as a pixel electrode is formed over the second electrode layer 4031 with the insulating layer 4042 provided therebetween.

The first electrode layer 4034 and the second electrode layer 4031 can be formed using a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, indium tin oxide to which silicon oxide is added, or graphene.

Alternatively, the first electrode layer 4034 and the second electrode layer 4031 can be formed using one or more materials selected from metals such as tungsten (W), molybdenum (Mo), zirconium (Zr), hafnium (Hf), vanadium (V), niobium (Nb), tantalum (Ta), chromium (Cr), cobalt (Co), nickel (Ni), titanium (Ti), platinum (Pt), aluminum (Al), copper (Cu), and silver (Ag); an alloy of any of these metals; and a nitride of any of these metals.

A conductive composition containing a conductive high molecule (also referred to as a conductive polymer) can be used for the first electrode layer 4034 and the second electrode layer 4031.

A columnar spacer denoted by reference numeral 4035 is obtained by selective etching of an insulating layer and is provided in order to control the thickness of the liquid crystal layer 4008 (a cell gap). Alternatively, a spherical spacer may be used.

Alternatively, a liquid crystal composition exhibiting a blue phase for which an alignment film is unnecessary may be used for the liquid crystal layer 4008. In this case, the liquid crystal layer 4008 is in contact with the first electrode layer 4034 and the second electrode layer 4031.

Note that the insulating layer 4042 illustrated in FIG. 12C partly has an opening; thus, moisture included in the planarization insulating layer 4040 can be released through the opening. However, the opening is not necessarily provided depending on the quality of the insulating layer 4042 over the planarization insulating layer 4040.

The size of storage capacitor formed in the liquid crystal display device is set considering the leakage current of the transistor provided in the pixel portion or the like so that charge can be held for a predetermined period. The size of the storage capacitor may be set considering the off-state current of a transistor or the like. By using a transistor including the oxide semiconductor layer disclosed in this specification, the size of the storage capacitor can be reduced. Accordingly, the aperture ratio of each pixel can be improved.

In particular, it is preferable that a capacitor as a storage capacitor be not provided and that parasitic capacitance generated between the first electrode layer 4034 and the second electrode layer 4031 be used as a storage capacitor. Without the capacitor, the aperture ratio of a pixel can be further increased.

FIG. 12B illustrates an example of a pixel structure in the case where the capacitor as a storage capacitor is not provided for a pixel. The pixel has an intersection portion of a wiring 4050 electrically connected to the gate electrode layer of the transistor 4010 and a wiring 4052 electrically connected to one of a source electrode layer and a drain electrode layer of the transistor 4010. Since the pixel in FIG. 12B does not include the capacitor as a storage capacitor, the ratio of the area of the second electrode layer 4031 having an opening pattern to the area occupied by the pixel can be made large, and an extremely high aperture ratio can be obtained.

In the transistor including an oxide semiconductor layer, which is disclosed in this specification, the current in an off state (off-state current) can be made small. Accordingly, an electric signal such as image data can be held for a longer period and a writing interval can be set longer. Accordingly, frequency of refresh operation can be reduced, which leads to an effect of suppressing power consumption.

The transistor including an oxide semiconductor layer, which is disclosed in this specification, can have high field-effect mobility; thus, the transistor can operate at high speed. For example, when such a transistor is used for a liquid crystal display device, a switching transistor in a pixel portion and a driver transistor in a driver circuit portion can be formed over one substrate. In addition, by using such a transistor in a pixel portion, a high-quality image can be provided.

In the display device, a black matrix (a light-blocking layer), an optical member (an optical substrate) such as a polarizing member, a retardation member, or an anti-reflection member, and the like are provided as appropriate. For example, circular polarization with the polarizing plate and the retardation plate may be used. In addition, a backlight, a side light, or the like may be used as a light source.

As a display method in the pixel portion, a progressive method, an interlace method or the like can be employed. Further, color elements controlled in a pixel at the time of color display are not limited to three colors: R, G, and B (R, G, and B correspond to red, green, and blue, respectively). For example, R, G, B, and W (W corresponds to white); R, G, B, and one or more of yellow, cyan, magenta, and the like; or the like can be used. Further, the sizes of display regions may be different between respective dots of color elements. Note that the disclosed invention is not limited to the application to a display device for color display; the disclosed invention can also be applied to a display device for monochrome display.

In addition, the display device is preferably provided with a touch sensor.

More intuitively operable electronic devices can be each obtained by using a display device with a touch sensor for an electronic device or the like so that the display device overlaps with the pixel portion 4002. The touch sensor can be used as the input unit.

As the touch sensor provided for the display device, a capacitive touch sensor is preferably used. In addition, a variety of types such as a resistive type, a surface acoustic wave type, an infrared type, and an optical type can be used.

Examples of the capacitive touch sensor are typically of a surface capacitive type, a projected capacitive type, and the like. Further, examples of the projected capacitive type are of a self capacitive type, a mutual capacitive type, and the like mainly in accordance with the difference in the driving method. The use of a mutual capacitive type is preferable because multiple points can be sensed simultaneously.

When a touch sensor is provided for the display device, a layer functioning as a touch sensor can be arranged in various ways.

Figures 13A, 13B, 13C:
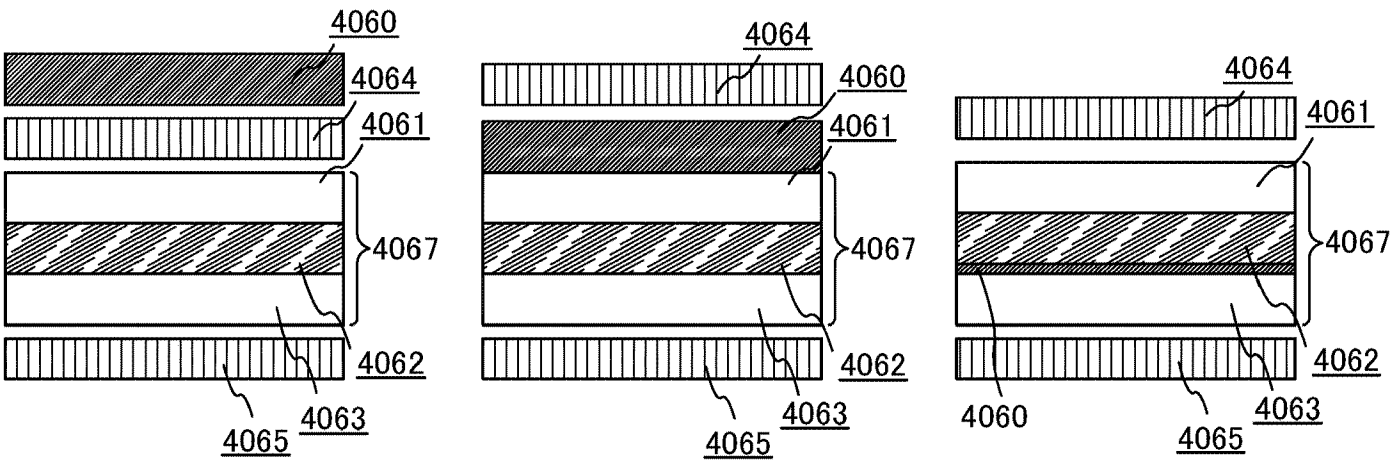
FIGS. 13A to 13C each illustrate a structure example of a display device including a touch sensor according to Embodiment.

FIGS. 13A to 13C each illustrate a structural example of a display device including a liquid crystal element and a touch sensor.

The display device in FIG. 13A includes a liquid crystal 4062, a pair of substrates (substrates 4061 and 4063) provided with the liquid crystal 4062 therebetween, a pair of polarizing plates (polarizing plates 4064 and 4065) provided outside the substrates 4061 and 4063, and a touch sensor 4060. Here, a structure including the liquid crystal 4062 and the substrates 4061 and 4063 are referred to as a display panel 4067.

The display device in FIG. 13A is a so-called external display device in which the touch sensor 4060 is placed outside the polarizing plate 4064 (or the polarizing plate 4065). With such a structure, the display device can have a touch sensor function in such a manner that the display panel 4067 and the touch sensor 4060 are separately formed and then they are overlapped with each other. Thus, the display device in FIG. 13A can be easily manufactured without a special step.

In the display device in FIG. 13A, the touch sensor 4060 is preferably formed over tempered glass. The tempered glass which is preferably used here is one that has been subjected to physical or chemical treatment by an ion exchange method, a thermal tempering method, or the like and has a surface to which compressive stress has been added. When the touch sensor is provided on one surface of the tempered glass and an opposite surface thereof is provided on the outermost surface of an electronic device to be used as a touch surface for example, the total thickness of the device can be small.

The display device in FIG. 13B is a so-called on-cell display device in which the touch sensor 4060 is positioned between the polarizing plate 4064 and the substrate 4061 (or between the polarizing plate 4065 and the substrate 4063). With such a structure, the thickness of the display device can be reduced by using the substrate 4061 in common with a formation substrate of the touch sensor 4060, for example.

The display device in FIG. 13C is a so-called in-cell display device in which the touch sensor 4060 is positioned between the substrate 4061 and the substrate 4063. With such a structure, the thickness of the display device can be further reduced. For example, such a thin display device can be achieved in such a manner that a layer functioning as a touch sensor is formed on the liquid crystal 4062 side of a surface of the substrate 4061 (or the substrate 4063) with use of a transistor, a wiring, an electrode, and the like included in the display panel 4067. Further, in the case of using an optical touch sensor, a structure provided with a photoelectric conversion element may be employed.

Note that the display device including a liquid crystal element is described here; however, a function of a touch sensor can be properly added to various display devices such as a display device provided with an organic EL element and electronic paper.

Note that a specific structure example of the touch sensor is described in Embodiment 5.

The semiconductor device having a display function (display device) described in this embodiment can be applied to a display unit included in an information processing device of one embodiment of the present invention. The method for driving an information processing device described in Embodiment 1 is applied and a program for driving the information processing device described in Embodiment 1 is applied to the arithmetic portion, whereby eye fatigue of a user can be suppressed, and eye-friendly display can be performed by the semiconductor device having a display function described in this embodiment.

This embodiment can be combined with any of the other embodiments disclosed in this specification as appropriate.

(Embodiment 5)

When a touch sensor (contact detector) is provided for a display device according to one embodiment of the present invention, the display device can function as a touch panel. In this embodiment, a display device provided with a touch sensor (hereinafter, referred to as a touch panel) is described with reference to FIGS. 14A and 14B and FIG. 15. Hereinafter, description of the same portions as the above embodiments is omitted or is simplified in some cases.

The touch panel described in this embodiment can include part of the display unit and part of the input unit described in the above embodiment.

Figure 14A:
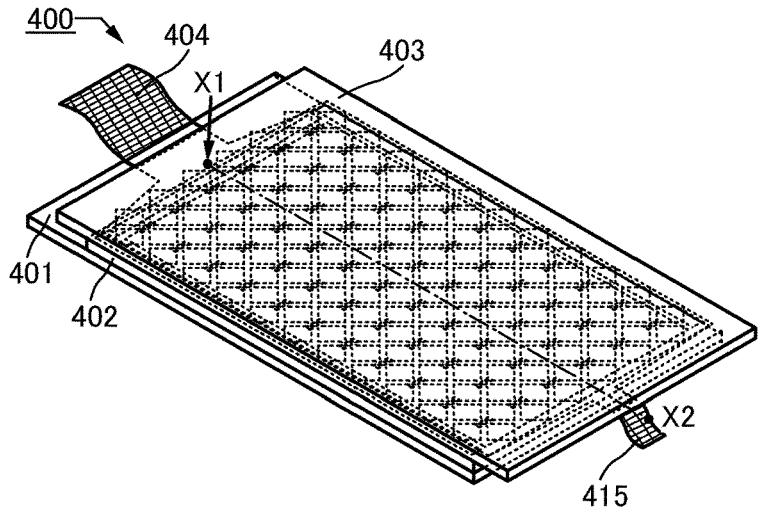
FIGS. 14A and 14B illustrate a structure example of a display device including a touch sensor according to Embodiment.
Figure 14B:
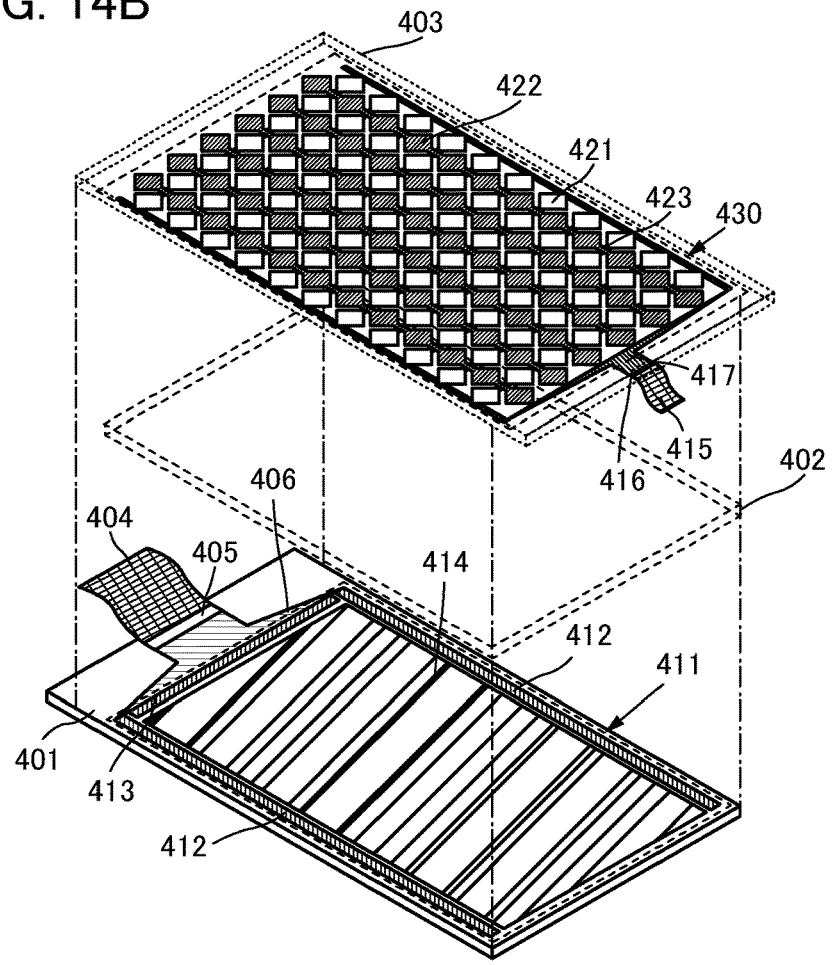

FIG. 14A is a schematic perspective view of a touch panel 400 described in this embodiment. Note that FIGS. 14A and 14B illustrate only major components for simplicity. FIG. 14B is a developed view of the schematic perspective view of the touch panel 400.

The touch panel 400 includes a display portion 411 sandwiched between a first substrate 401 and a second substrate 402 and a touch sensor 430 sandwiched between the second substrate 402 and a third substrate 403.

The first substrate 401 is provided with the display portion 411 and a plurality of wirings 406 electrically connected to the display portion 411. The plurality of wirings 406 are led to the periphery of the first substrate 401, and part of the wirings form part of an external connection electrode 405 for electrical connection to an FPC 404.

The display portion 411 includes a pixel portion 414 including a plurality of pixels, a source driver circuit 412, and a gate driver circuit 413, and is sealed by the first substrate 401 and the second substrate 402. Although FIG. 14B illustrates a structure in which two source driver circuits 412 are positioned on both sides of the pixel portion 414, one source driver circuit 412 may be positioned along one side of the pixel portion 414.

As a display element which can be used in the pixel portion 414 of the display portion 411, any of a variety of display elements such as an organic EL element, a liquid crystal element, and a display element performing display by an electrophoretic method, an electronic liquid powder method, or the like can be used. In this embodiment, the case where a liquid crystal element is used as the display element will be described.

The third substrate 403 includes the touch sensor 430 and a plurality of wirings 417 electrically connected to the touch sensor 430. The touch sensor 430 is provided on a surface of the third substrate 403 on a side facing the second substrate 402. The plurality of wirings 417 is led to the periphery of the third substrate 403, and part of the wirings form part of an external connection electrode 416 for electrical connection to an FPC 415. Note that in FIG. 14B, electrodes, wirings, and the like of the touch sensor 430 which are provided on the back side of the third substrate 403 (the back side of the diagram) are indicated by solid lines for clarity.

The touch sensor 430 illustrated in FIG. 14B is an example of a projected capacitive touch sensor. The touch sensor 430 includes electrodes 421 and electrodes 422. The electrode 421 and the electrode 422 are each electrically connected to any one of the plurality of wirings 417.

Here, each of the electrode 422 is in the form of a series of quadrangles arranged in one direction as illustrated in FIGS. 14A and 14B. Each of the electrodes 421 is in the form of a quadrangle. The plurality of electrodes 421 arranged in a line in a direction intersecting with the direction in which the electrode 422 extends is electrically connected to each other by the wiring 423. The electrode 422 and the wiring 423 are preferably arranged so that the area of the intersecting portion of the electrode 422 and the wiring 423 becomes as small as possible. Such a shape can reduce the area of a region where the electrodes are not provided and decrease luminance unevenness of light passing through the touch sensor 430 which are caused by a difference in transmittance depending on whether the electrodes are provided or not.

Note that the shapes of the electrode 421 and the electrode 422 are not limited thereto and can be any of a variety of shapes. For example, a structure may be employed in which the plurality of electrodes 421 are arranged so that gaps between the electrodes 421 are reduced as much as possible, and the electrode 422 is spaced apart from the electrodes 421 with an insulating layer interposed therebetween to have regions not overlapping with the electrodes 421. In that case, between two adjacent electrodes 422, it is preferable to provide a dummy electrode which is electrically insulated from these electrodes, whereby the area of regions having different transmittances can be reduced.

Figure 15:
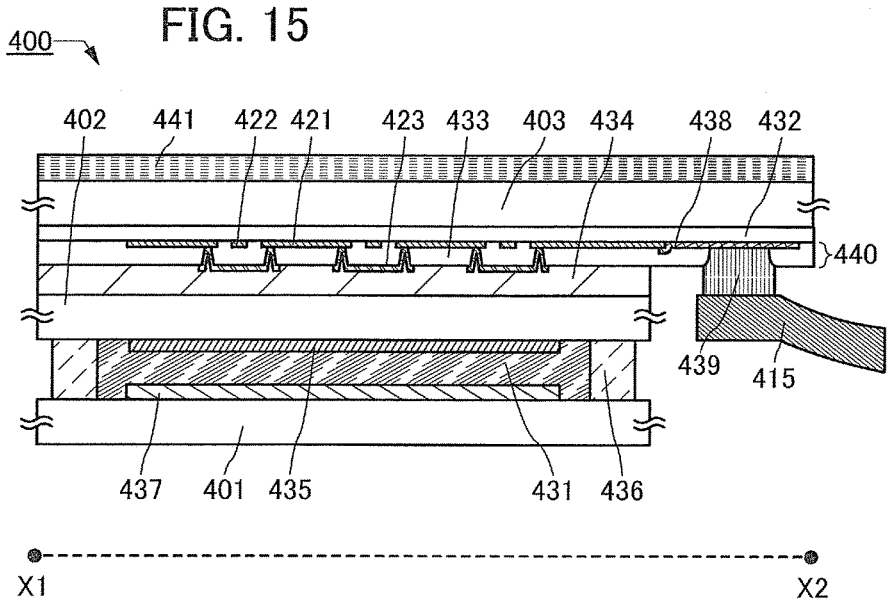
FIG. 15 illustrates a structure example of a display device including a touch sensor according to Embodiment.

FIG. 15 is a cross-sectional view of the touch panel 400 taken along X1-X2 in FIG. 14A.

A switching element layer 437 is provided over the first substrate 401. The switching element layer 437 includes at least a transistor, and may further include a capacitor or the like. Furthermore, the switching element layer 437 may include a driver circuit (a gate driver circuit and/or a source driver circuit), a wiring, an electrode, or the like.

A color filter layer 435 is provided on one surface of the second substrate 402. The color filter layer 435 includes a color filter which overlaps with a liquid crystal element. When the color filter layer 435 is provided with three color filters of red (R), green (G), and blue (B), a full-color liquid crystal display device can be obtained.

The color filter layer 435 can be formed using a photosensitive material including a pigment by a photolithography process. As the color filter layer 435, a black matrix may be provided between color filters with different colors. Furthermore, an overcoat may be provided to cover the color filters and the black matrix.

Note that one of electrodes of the liquid crystal element may be formed on the color filter layer 435 in accordance with the structure of the liquid crystal element. Note that the electrode becomes part of the liquid crystal element to be formed later. An alignment film may be provided over the electrode.

A liquid crystal 431 is sealed between the first substrate 401 and the second substrate 402 with a sealant 436. The sealant 436 is provided to surround the switching element layer 437 and the color filter layer 435.

As the sealant 436, a thermosetting resin or an ultraviolet curable resin can be used; for example, an organic resin such as an acrylic resin, an urethane resin, an epoxy resin, or a resin having a siloxane bond can be used. Alternatively, the sealant 436 may be formed with glass frit including a low-melting-point glass. Further alternatively, the sealant 436 may be formed with a combination of the organic resin and the glass frit. For example, a structure in which the organic resin is provided in contact with the liquid crystal 431 and the glass frit is provided outside the resin can prevent water and the like from entering the liquid crystal from the outside.

A touch sensor is provided over the second substrate 402. A sensor layer 440 is provided on one surface of the third substrate 403 with an insulating layer 432 provided therebetween. The sensor layer 440 is bonded to the second substrate 402 with an adhesive layer 434 provided therebetween. A polarizing plate 441 is provided on the other surface of the third substrate 403.

The touch sensor can be formed over a liquid crystal panel as follows: the sensor layer 440 is formed over the third substrate 403; and the sensor layer 440 is bonded to the second substrate 402 with the adhesive layer 434 that is on the sensor layer 440, interposed therebetween.

The insulating layer 432 can be formed using an oxide such as a silicon oxide. The electrodes 421 having a light-transmitting property and the electrodes 422 having a light-transmitting property are provided in contact with the insulating layer 432. The electrodes 421 and the electrodes 422 are formed in the following manner: a conductive film is formed over the insulating layer 432 over the third substrate 403 by a sputtering method, and selectively etched by a known patterning technique such as a photolithography process. As a light-transmitting conductive material, a conductive oxide such as indium oxide, indium tin oxide, indium zinc oxide, zinc oxide, or zinc oxide to which gallium is added can be used.

A wiring 438 is electrically connected to the electrode 421 or the electrode 422. Part of the wiring 438 serves as an external connection electrode which is electrically connected to the FPC 415. For the wiring 438, a metal material such as aluminum, gold, platinum, silver, nickel, titanium, tungsten, chromium, molybdenum, iron, cobalt, copper, or palladium or an alloy material containing any of these metal materials can be used.

The electrodes 422 are provided to form stripes extended in one direction.

The electrodes 421 are provided such that one electrode 422 is sandwiched between a pair of electrodes 421, and the wiring 423 eclectically connecting them is provided to intersect with the electrodes 422. Here, the one electrode 422 and the pair of electrodes 421 which are electrically connected to each other by the wiring 423 do not necessarily intersect orthogonally and may form an angle of less than 90°.

An insulating layer 433 is provided to cover the electrodes 421 and the electrodes 422. As a material of the insulating layer 433, for example, a resin such as acrylic or epoxy, a resin having a siloxane bond, or an inorganic insulating material such as silicon oxide, silicon oxynitride, or aluminum oxide can be used. Openings reaching the electrodes 421 are formed in the insulating layer 433, and the wirings 423 electrically connected to the electrodes 421 are provided over the insulating layer 433 and in the openings. The wiring 423 is preferably formed using a light-transmitting conductive material similar to that of the electrode 421 and the electrode 422, in which case the aperture ratio of the touch panel can be improved. Although a material which is the same as that of the electrode 421 and the electrode 422 may be used for the wiring 423, a material having higher conductivity than the materials of the electrode 421 and the electrode 422 is preferably used for the wiring 423.

An insulating layer covering the insulating layer 433 and the wirings 423 may be provided. The insulating layer can serve as a protection layer.

An opening reaching the wiring 438 is formed in the insulating layer 433 (and the insulating layer serving as a protection layer). A connection layer 439 provided in the opening electrically connects the FPC 415 with the wiring 438. For the connection layer 439, an anisotropic conductive film (ACF), anisotropic conductive paste (ACP), or the like can be used.

It is preferable that the adhesive layer 434 by which the sensor layer 440 is bonded to the second substrate 402 have a light-transmitting property. For example, a thermosetting resin or an ultraviolet curable resin can be used; specifically, a resin such as an acrylic resin, an urethane resin, an epoxy resin, or a resin having a siloxane bond can be used.

As the polarizing plate 441, a known polarizing plate can be used. For the polarizing plate 441, a material capable of producing linearly polarized light from natural light or circularly polarized light is used. For example, a material whose optical anisotropy is obtained by disposing dichroic substances in one direction can be used. Such a polarizing plate can be formed in such a manner that an iodine-based compound or the like is adsorbed to a film such as a polyvinyl alcohol film and the film or the like is stretched in one direction, for example. Note that as the dichroic substance, a dye-based compound or the like as well as an iodine-based compound can be used. A film-like, sheet-like, or plate-like material is used for the polarizing plate 441.

Note that in this embodiment, an example is described in which a projected capacitive touch sensor is used for the sensor layer 440; however, the sensor layer 440 is not limited to this, and a sensor functioning as a touch sensor which senses proximity or touch of a conductive object to be sensed such as a finger from an outer side than the polarizing plate can be used. The touch sensor provided in the sensor layer 440 is preferably a capacitive touch sensor. Examples of the capacitive touch sensor are of a surface capacitive type, of a projected capacitive type, and the like. Further, examples of the projected capacitive type are of a self capacitive type, a mutual capacitive type, and the like mainly in accordance with the difference in the driving method. The use of a mutual capacitive type is preferable because multiple points can be sensed simultaneously.

In the touch panel described in this embodiment, since the refresh rate of display can be reduced, a user can see the same image for a long time as much as possible; thus, perceivable flickers in a screen can be reduced. Furthermore, the size of one pixel is small and thus high resolution display is possible, so that precise and smooth display can be achieved. Moreover, at the time of still image display, deterioration of image quality caused by a change in gray level can be reduced and power consumed by the touch panel can be reduced.

The touch panel described in this embodiment can include part of the display unit and part of the input unit described in the above embodiment. The method for driving an information processing device described in Embodiment 1 is applied and a program for driving the information processing device described in Embodiment 1 is executed by the arithmetic portion, whereby eye fatigue of a user can be suppressed, and eye-friendly display can be performed by the touch panel described in this embodiment.

This embodiment can be combined with any of the other embodiments disclosed in this specification as appropriate.

(Embodiment 6)

Examples of a semiconductor and a semiconductor film which are preferably used for the region where a channel is formed in the transistor described in the above embodiment will be described below.

An oxide semiconductor has a wide energy gap of 3.0 eV or more. A transistor including an oxide semiconductor film obtained by processing of the oxide semiconductor in an appropriate condition and a sufficient reduction in carrier density of the oxide semiconductor can have much lower leakage current between a source and a drain in an off state (off-state current) than a conventional transistor including silicon.

When an oxide semiconductor film is used for the transistor, the thickness of the oxide semiconductor film is preferable greater than or equal to 2 nm to less than or equal to 40 nm An applicable oxide semiconductor preferably contains at least indium (In) or zinc (Zn). In particular, In and Zn are preferably contained. In addition, as a stabilizer for reducing variation in electric characteristics of the transistor using the oxide semiconductor, one or more selected from gallium (Ga), tin (Sn), hafnium (Hf), zirconium (Zr), titanium (Ti), scandium (Sc), yttrium (Y), and an lanthanoid (such as cerium (Ce), neodymium (Nd), or gadolinium (Gd), for example) is preferably contained.

As the oxide semiconductor, for example, any of the following can be used: indium oxide, tin oxide, zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—Zr—Zn-based oxide, an In—Ti—Zn-based oxide, an In—Sc—Zn-based oxide, an In—Y—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide.

Here, an "In—Ga—Zn-based oxide" means an oxide containing In, Ga, and Zn as its main components and there is no particular limitation on the ratio of In: Ga: Zn. The In—Ga—Zn-based oxide may contain a metal element other than the In, Ga, and Zn.

Alternatively, a material represented by $InMO_3(ZnO)_m$ (m>0 is satisfied, and m is not an integer) may be used as an oxide semiconductor. Note that M represents one or more metal elements selected from Ga, Fe, Mn, and Co, or the above-described element as a stabilizer. Alternatively, as the oxide semiconductor, a material expressed by a chemical formula, $In_2SnO_5(ZnO)_n$ (n>0, n is an integer) may be used.

For example, In—Ga—Zn-based oxide with an atomic ratio where In:Ga:Zn=1:1:1, In:Ga:Zn=3:1:2, In:Ga:Zn=1:3:2, or In:Ga:Zn=2:1:3, or an oxide whose composition is in the neighborhood of the above compositions can be used.

Note that if the oxide semiconductor film contains a large amount of hydrogen, the hydrogen and the oxide semiconductor are bonded to each other, so that part of the hydrogen serves as a donor and causes generation of an electron which is a carrier. As a result, the threshold voltage of the transistor shifts in the negative direction. Therefore, it is preferable that, after formation of the oxide semiconductor film, dehydration treatment (dehydrogenation treatment) be performed to remove hydrogen or moisture from the oxide semiconductor film so that the oxide semiconductor film is highly purified to contain impurities as little as possible.

Note that oxygen in the oxide semiconductor film is also reduced by the dehydration treatment (dehydrogenation treatment) in some cases. Therefore, it is preferable that oxygen whose amount is reduced in the dehydration treatment (dehydrogenation treatment) be added to the oxide semiconductor or oxygen be supplied to fill the oxygen vacancies in the oxide semiconductor film. In this specification and the like, supplying oxygen to an oxide semiconductor film may be expressed as oxygen adding treatment, or treatment for making the oxygen content of an oxide semiconductor film be in excess of that of the stoichiometric composition may be expressed as treatment for making an oxygen-excess state.

In this manner, hydrogen or moisture is removed from the oxide semiconductor film by the dehydration treatment (dehydrogenation treatment) and oxygen vacancies therein are filled the oxygen adding treatment, so that the oxide semiconductor film can be an i-type (intrinsic) oxide semiconductor film or an oxide semiconductor film extremely close to an i-type oxide semiconductor (a substantially i-type oxide semiconductor). Note that the substantially i-type oxide semiconductor means that the oxide semiconductor film includes extremely few (close to zero) carriers derived from a donor, and the carrier concentration thereof is lower than or equal to $1\times10^{17}/cm^3$, lower than or equal to $1\times10^{16}/cm^3$, lower than or equal to $1\times10^{15}/cm^3$, lower than or equal to $1\times10^{14}/cm^3$, or lower than or equal to $1\times10^{13}/cm^3$.

In this manner, the transistor including an i-type (intrinsic) or substantially i-type oxide semiconductor film can have extremely favorable off-state current characteristics. For example, the drain current at the time when the transistor including an oxide semiconductor film is in an off-state at room temperature (25° C.) can be less than or equal to $1\times10^{-18}$ A, preferably less than or equal to $1\times10^{-21}$ A, and further preferably $1\times10^{-24}$ A; or at 85° C., less than or equal to $1\times10^{-15}$ A, preferably $1\times10^{-18}$ A, further preferably less than or equal to $1\times10^{-21}$ A. An off state of a transistor refers to a state where gate voltage is lower than the threshold voltage in an n-channel transistor. Specifically, the transistor is in an off state when the gate voltage is lower than the threshold voltage by 1V or more, 2V or more, or 3V or more.

Although the variety of films such as the semiconductor film (for example, oxide semiconductor film) which are described in the above embodiment can be formed by a sputtering method or a plasma chemical vapor deposition (CVD) method, such films may be formed by another method, e.g., a thermal CVD method. A metal organic chemical vapor deposition (MOCVD) method or an atomic layer deposition (ALD) method may be employed as an example of a thermal CVD method.

Deposition by an ALD method may be performed in such a manner that the pressure in a chamber is set to an atmospheric pressure or a reduced pressure, source gases for reaction are sequentially introduced into the chamber, and then the sequence of the gas introduction is repeated. For example, two or more kinds of source gases are sequentially supplied to the chamber by switching respective switching valves (also referred to as high-speed valves). For example, a first source gas is introduced, an inert gas (e.g., argon or nitrogen) or the like is introduced at the same time as or after the introduction of the first gas so that the source gases are not mixed, and then a second source gas is introduced. Note that in the case where the first source gas and the inert gas are introduced at a time, the inert gas serves as a carrier gas, and the inert gas may also be introduced at the same time as the introduction of the second source gas. Alternatively, the first source gas may be exhausted by vacuum evacuation instead of the introduction of the inert gas, and then the second source gas may be introduced. The first source gas is adsorbed on the surface of the substrate to form a first layer; then the second source gas is introduced to react with the first layer; as a result, a second layer is stacked over the first layer, so that a thin film is formed. The sequence of the gas introduction is repeated plural times until a desired thickness is obtained, whereby a thin film with excellent step coverage can be formed. The thickness of the thin film can be adjusted by the number of repetitions times of the sequence of the gas introduction; therefore, an ALD method makes it possible to accurately adjust a thickness and thus is suitable for manufacturing a minute FET.

The variety of films such as the semiconductor film, which are described in the above embodiment can be formed by a thermal CVD method such as a MOCVD method or an ALD method. For example, in the case where an In—Ga—Zn—O film is formed, trimethylindium, trimethylgallium, and dimethylzinc are used. Note that the chemical formula of trimethylindium is $(CH_3)_3In$. The chemical formula of trimethylgallium is $(CH_3)_3Ga$. The chemical formula of dimethylzinc is $Zn(CH_3)_2$. Without limitation to the above combination, triethylgallium (chemical formula: $(C_2H_5)_3Ga$) can be used instead of trimethylgallium, and diethylzinc (chemical formula: $Zn(C_2H_5)_2$) can be used instead of dimethylzinc.

For example, in the case where an oxide semiconductor film, e.g., an $InGaZnO_X$ (X>0) film is formed using a deposition apparatus employing ALD, an $In(CH_3)_3$ gas and an $O_3$ gas are sequentially introduced plural times to form an $InO_2$ layer, a $Ga(CH_3)_3$ gas and an $O_3$ gas are introduced at a time to form a GaO layer, and then a $Zn(CH_3)_2$ gas and an $O_3$ gas are introduced at a time to form a ZnO layer. Note that the order of these layers is not limited to this example. A mixed compound layer such as an $InGaO_2$ layer, an $InZnO_2$ layer, a GaInO layer, a ZnInO layer or a GaZnO layer may be formed by mixing of these gases. Note that although an $H_2O$ gas which is obtained by bubbling with an inert gas such as Ar may be used instead of an $O_3$ gas, it is preferable to use an $O_3$ gas, which does not contain H. Further, instead of an $In(CH_3)_3$ gas, an $In(C_2H_5)_3$ gas may be used. Instead of a $Ga(CH_3)_3$ gas, a $Ga(C_2H_5)_3$ gas may be used. Instead of an $In(CH_3)_3$ gas, an $In(C_2H_5)_3$ may be used.

Furthermore, a $Zn(CH_3)_2$ gas may be used.

A structure of an oxide semiconductor film is described below.

In this specification, a term "parallel" indicates that the angle formed between two straight lines is greater than or equal to −10° and less than or equal to 10°, and accordingly also includes the case where the angle is greater than or equal to −5° and less than or equal to 5°. In addition, a term "perpendicular" indicates that the angle formed between two straight lines is greater than or equal to 80° and less than or equal to 100°, and accordingly includes the case where the angle is greater than or equal to 85° and less than or equal to 95°.

In this specification, the trigonal and rhombohedral crystal systems are included in the hexagonal crystal system.

An oxide semiconductor film is classified roughly into a single-crystal oxide semiconductor film and a non-single-crystal oxide semiconductor film. The non-single-crystal oxide semiconductor film includes any of a c-axis aligned crystalline oxide semiconductor (CAAC-OS) film, a polycrystalline oxide semiconductor film, a microcrystalline oxide semiconductor film, an amorphous oxide semiconductor film, and the like.

First, a CAAC-OS film will be described.

The CAAC-OS film is one of oxide semiconductor films having a plurality of c-axis aligned crystal parts.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflected by a surface over which the CAAC-OS film is formed (hereinafter, a surface over which the CAAC-OS film is formed is referred to as a formation surface) or a top surface of the CAAC-OS film, and is arranged in parallel to the formation surface or the top surface of the CAAC-OS film.

On the other hand, according to the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

From the results of the cross-sectional TEM image and the plan TEM image, alignment is found in the crystal parts in the CAAC-OS film.

Most of the crystal parts included in the CAAC-OS film each fit inside a cube whose one side is less than 100 nm Thus, there is a case where a crystal part included in the CAAC-OS film fits a cube whose one side is less than 10 nm, less than 5 nm, or less than 3 nm Note that when a plurality of crystal parts included in the CAAC-OS film are connected to each other, one large crystal region is formed in some cases. For example, a crystal region with an area of 2500 $nm^2$ or more, 5 $\mu m^2$ or more, or 1000 $\mu m^2$ or more is observed in some cases in the plan TEM image.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (φ scan) is performed under conditions where the sample is rotated around a normal vector of a sample surface as an axis (φ axis) with 2θ fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when φ scan is performed with 2θ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned with a direction parallel to a normal vector of a formation surface or a normal vector of a top surface. Thus, for example, in the case where a shape of the CAAC-OS film is changed by etching or the like, the c-axis might not be necessarily parallel to a normal vector of a formation surface or a normal vector of a top surface of the CAAC-OS film.

Further, distribution of c-axis aligned crystal parts in the CAAC-OS film is not necessarily uniform. For example, in the case where crystal growth leading to the crystal parts of the CAAC-OS film occurs from the vicinity of the top surface of the film, the proportion of the c-axis aligned crystal parts in the vicinity of the top surface is higher than that in the vicinity of the formation surface in some cases. Further, when an impurity is added to the CAAC-OS film, a region to which the impurity is added is altered, and the proportion of the c-axis aligned crystal parts in the CAAC-OS film varies depending on regions, in some cases.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ do not appear at around 36°.

The CAAC-OS film is an oxide semiconductor film having low impurity concentration. The impurity is an element other than the main components of the oxide semiconductor film, such as hydrogen, carbon, silicon, or a transition metal element. In particular, an element that has higher bonding strength to oxygen than a metal element included in the oxide semiconductor film, such as silicon, disturbs the atomic arrangement of the oxide semiconductor film by depriving the oxide semiconductor film of oxygen and causes a decrease in crystallinity. Further, a heavy metal such as iron or nickel, argon, carbon dioxide, or the like has a large atomic radius (molecular radius), and thus disturbs the atomic arrangement of the oxide semiconductor film and causes a decrease in crystallinity when it is contained in the oxide semiconductor film. Note that the impurity contained in the oxide semiconductor film might serve as a carrier trap or a carrier generation source.

The CAAC-OS film is an oxide semiconductor film having a low density of defect states. In some cases, oxygen vacancies in the oxide semiconductor film serve as carrier traps or serve as carrier generation sources when hydrogen is captured therein.

The state in which impurity concentration is low and density of defect states is low (the number of oxygen vacancies is small) is referred to as a "highly purified intrinsic" or "substantially highly purified intrinsic" state. A highly purified intrinsic or substantially highly purified intrinsic oxide semiconductor film has few carrier generation sources, and thus can have a low carrier density. Thus, a transistor including the oxide semiconductor film rarely has negative threshold voltage (is rarely normally on). The highly purified intrinsic or substantially highly purified intrinsic oxide semiconductor film has few carrier traps. Accordingly, the transistor including the oxide semiconductor film has little variation in electrical characteristics and high reliability. Electric charge trapped by the carrier traps in the oxide semiconductor film takes a long time to be released, and might behave like fixed electric charge. Thus, the transistor which includes the oxide semiconductor film having high impurity concentration and a high density of defect states has unstable electrical characteristics in some cases.

With use of the CAAC-OS film in a transistor, variation in the electrical characteristics of the transistor due to irradiation with visible light or ultraviolet light is small.

Next, a microcrystalline oxide semiconductor film will be described.

In an image obtained with the TEM, crystal parts cannot be found clearly in the microcrystalline oxide semiconductor in some cases. In most cases, a crystal part in the microcrystalline oxide semiconductor is greater than or equal to 1 nm and less than or equal to 100 nm, or greater than or equal to 1 nm and less than or equal to 10 nm. A microcrystal with a size greater than or equal to 1 nm and less than or equal to 10 nm, or a size greater than or equal to 1 nm and less than or equal to 3 nm is specifically referred to as nanocrystal (nc). An oxide semiconductor film including nanocrystal (nc) is referred to as an nc-OS (nanocrystalline oxide semiconductor) film. In an image obtained with TEM, a crystal grain cannot be found clearly in the nc-OS film in some cases.

In the nc-OS film, a microscopic region (for example, a region with a size greater than or equal to 1 nm and less than or equal to 10 nm, in particular, a region with a size greater than or equal to 1 nm and less than or equal to 3 nm) has a periodic atomic order. Further, there is no regularity of crystal orientation between different crystal parts in the nc-OS film; thus, the orientation of the whole film is not observed. Accordingly, in some cases, the nc-OS film cannot be distinguished from an amorphous oxide semiconductor depending on an analysis method. For example, when the nc-OS film is subjected to structural analysis by an out-of-plane method with an XRD apparatus using an X-ray having a diameter larger than that of a crystal part, a peak which shows a crystal plane does not appear. Further, a halo pattern is shown in a selected-area electron diffraction pattern of the nc-OS film obtained by using an electron beam having a probe diameter (e.g., larger than or equal to 50 nm) larger than a diameter of a crystal part. Meanwhile, spots are shown in a nanobeam electron diffraction pattern of the nc-OS film obtained by using an electron beam having a probe diameter (e.g., larger than or equal to 1 nm and smaller than or equal to 30 nm) close to, or smaller than or equal to a diameter of a crystal part. Further, in a nanobeam electron diffraction pattern of the nc-OS film, regions with high luminance in a circular (ring) pattern are shown in some cases. Also in a nanobeam electron diffraction pattern of the nc-OS film, a plurality of spots are shown in a ring-like region in some cases.

Since the nc-OS film is an oxide semiconductor film having more regularity than the amorphous oxide semiconductor film, the nc-OS film has a lower density of defect states than the amorphous oxide semiconductor film. However, there is no regularity of crystal orientation between different crystal parts in the nc-OS film; hence, the nc-OS film has a higher density of defect states than the CAAC-OS film.

Note that an oxide semiconductor film may be a stacked film including two or more films of an amorphous oxide semiconductor film, a microcrystalline oxide semiconductor film, and a CAAC-OS film, for example.

For example, a CAAC-OS film can be deposited by a sputtering method using a polycrystalline oxide semiconductor sputtering target. When ions collide with the sputtering target, a crystal region included in the sputtering target may be separated from the target along an a-b plane; in other words, a sputtered particle having a plane parallel to an a-b plane (flat-plate-like sputtered particle or pellet-like sputtered particle) may flake off from the sputtering target. In this case, the flat-plate-like sputtered particle or the pellet-like sputtered particle reaches a surface where the CAAC-OS film is to be deposited while maintaining its crystal state, whereby the CAAC-OS film can be deposited.

The flat-plate-like sputtered particle has, for example, an equivalent circle diameter of a plane parallel to the a-b plane which is greater than or equal to 3 nm and less than or equal to 10 nm, and a thickness (length in the direction perpendicular to the a-b plane) greater than or equal to 0.7 nm and less than 1 nm. Note that in the flat-plate-like sputtered particle, the plane parallel to the a-b plane may be a regular triangle or a regular hexagon. Here, the term "equivalent circle diameter of a plane" refers to the diameter of a perfect circle having the same area as the plane.

For the deposition of the CAAC-OS film, the following conditions are preferably used.

By increasing the substrate temperature during the deposition, migration of flat-plate-like sputtered particles which have reached the substrate occurs, so that a flat plane of the sputtered particles is attached to the substrate. At this time, the sputtered particle is charged positively, whereby sputtered particles are attached to the substrate while repelling each other; thus, the sputtered particles do not overlap with each other randomly, and a CAAC-OS film with a uniform thickness can be deposited.

Specifically, the substrate temperature during the deposition is higher than or equal to 100° C. and lower than or equal to 740° C., preferably higher than equal to 200° C. and lower than or equal to 500° C.

By reducing the amount of impurities entering the CAAC-OS film during the deposition, the crystal state can be prevented from being broken by the impurities. For example, the concentration of impurities (e.g., hydrogen, water, carbon dioxide, or nitrogen) which exist in the deposition chamber may be reduced. Furthermore, the concentration of impurities in a deposition gas may be reduced. Specifically, a deposition gas whose dew point is −80° C. or lower, preferably −100° C. or lower is used.

Furthermore, it is preferable that the proportion of oxygen in the deposition gas be increased and the power be optimized in order to reduce plasma damage at the deposition. The proportion of oxygen in the deposition gas is 30 vol % or higher, preferably 100 vol %.

After the CAAC-OS film is deposited, heat treatment may be performed. The temperature of the heat treatment is higher than or equal to 100° C. and lower than or equal to 740° C., preferably higher than or equal to 200° C. and lower than or equal to 500° C. Further, the heat treatment is performed for 1 minute to 24 hours, preferably 6 minutes to 4 hours. The heat treatment may be performed in an inert atmosphere or an oxidation atmosphere. It is preferable to perform heat treatment in an inert atmosphere and then to perform heat treatment in an oxidation atmosphere. The heat treatment in an inert atmosphere can reduce the concentration of impurities in the CAAC-OS film for a short time. At the same time, the heat treatment in an inert atmosphere may generate oxygen vacancies in the CAAC-OS film. In this case, the heat treatment in an oxidation atmosphere can reduce the oxygen vacancies. The heat treatment can further increase the crystallinity of the CAAC-OS film. Note that the heat treatment may be performed under a reduced pressure of 1000 Pa or lower, 100 Pa or lower, 10 Pa or less, or 1 Pa or lower. The heat treatment under the reduced atmosphere can reduce the concentration of impurities in the CAAC-OS film for a shorter time.

As an example of the sputtering target, an In—Ga—Zn—O compound target is described below.

The In—Ga—Zn—O compound target, which is polycrystalline, is made by mixing $InO_X$ powder, $GaO_Y$ powder, and $ZnO_Z$ powder in a predetermined molar ratio, applying pressure, and performing heat treatment at a temperature higher than or equal to 1000° C. and lower than or equal to 1500° C. Note that X, Y, and Z are each a given positive number. Here, the predetermined molar ratio of $InO_X$ powder to $GaO_Y$ powder and $ZnO_Z$ powder is, for example, 1:1:1, 1:1:2, 1:3:2, 1:9:6, 2:1:3, 2:2:1, 3:1:1, 3:1:2, 3:1:4, 4:2:3, 8:4:3, or a ratio close to these ratios. The kinds of powder and the molar ratio for mixing powder may be determined as appropriate depending on the desired sputtering target.

Alternatively, the CAAC-OS film may be formed in the following manner.

First, a first oxide semiconductor film is formed to a thickness greater than or equal to 1 nm and less than 10 nm. The first oxide semiconductor film is formed by a sputtering method. Specifically, the substrate temperature during the deposition is higher than or equal to 100° C. and lower than or equal to 500° C., preferably higher than or equal to 150° C. and lower than or equal to 450° C., and the proportion of oxygen in the deposition gas is higher than or equal to 30 vol. %, preferably 100 vol. %.

Next, heat treatment is performed so that the first oxide semiconductor film serves as a first CAAC-OS film with high crystallinity. The heat treatment is performed at a temperature higher than or equal to 350° C. and lower than or equal to 740° C., preferably higher than or equal to 450° C. and lower than or equal to 650° C. Further, the heat treatment is performed for 1 minute to 24 hours, preferably 6 minutes to 4 hours. The heat treatment may be performed in an inert atmosphere or an oxidation atmosphere. It is preferable to perform heat treatment in an inert atmosphere and then to perform heat treatment in an oxidation atmosphere. The heat treatment in an inert atmosphere can reduce the concentration of impurities in the first oxide semiconductor film in a short time. At the same time, the heat treatment in an inert atmosphere may cause generation of oxygen vacancies in the first oxide semiconductor film. In this case, the heat treatment in an oxidation atmosphere can reduce the oxygen vacancies. Note that the heat treatment may be performed under a reduced pressure, such as 1000 Pa or lower, 100 Pa or lower, 10 Pa or lower, or 1 Pa or lower. The heat treatment under the reduced atmosphere can reduce the concentration of impurities in the first oxide semiconductor film for a shorter time.

The first oxide semiconductor film with a thickness greater than or equal to 1 nm and less than 10 nm can be easily crystallized by heat treatment compared to the case where the first oxide semiconductor film has a thickness of greater than or equal to 10 nm Next, a second oxide semiconductor film that has the same composition as the first oxide semiconductor film is formed to a thickness greater than or equal to 10 nm and less than or equal to 50 nm. The second oxide semiconductor film is preferably formed by a sputtering method. Specifically, the substrate temperature during the deposition is higher than or equal to 100° C. and lower than or equal to 500° C., preferably higher than or equal to 150° C. and lower than or equal to 450° C., and the proportion of oxygen in the deposition gas is higher than or equal to 30 vol. %, preferably 100 vol. %.

Next, heat treatment is performed so that solid phase growth of the second oxide semiconductor film from the first CAAC-OS film is performed. Thus, the second CAAC-OS film can have high crystallinity. The heat treatment is performed at a temperature higher than or equal to 350° C. and lower than or equal to 740° C., preferably higher than or equal to 450° C. and lower than or equal to 650° C. Further, the heat treatment is performed for 1 minute to 24 hours, preferably 6 minutes to 4 hours. The heat treatment may be performed in an inert atmosphere or an oxidation atmosphere. It is preferable to perform heat treatment in an inert atmosphere and then to perform heat treatment in an oxidation atmosphere. The heat treatment in an inert atmosphere can reduce the concentration of impurities in the second oxide semiconductor film for a short time. At the same time, the heat treatment in an inert atmosphere may cause generation of oxygen vacancies in the second oxide semiconductor film. In this case, the heat treatment in an oxidation atmosphere can reduce the oxygen vacancies. Note that the heat treatment may be performed under a reduced pressure, such as 1000 Pa or lower, 100 Pa or lower, 10 Pa or lower, or 1 Pa or lower. The heat treatment under a reduced pressure can reduce the concentration of impurities in the second oxide semiconductor film in a shorter time.

As described above, the CAAC-OS film with a total thickness of 10 nm or more can be formed.

Further, the oxide semiconductor film may have a structure in which a plurality of oxide semiconductor films are stacked.

For example, the oxide semiconductor film may be provided with, between the oxide semiconductor film (referred to as a first layer for convenience) and a gate insulating film, a second layer which is formed of a constituent element of the first layer and whose electron affinity is lower than that of the first layer by 0.2 eV or more. At this time, when an electric field is applied from the gate electrode, a channel is formed in the first layer, and the channel is not formed in the second layer. The element included in the first layer is the same as that in the second layer; thus, interface scattering at the interface between the first layer and the second layer hardly occurs. Thus, provision of the second layer between the first layer and the gate insulating film can increase the field-effect mobility of the transistor.

Further, when a silicon oxide film, a silicon oxynitride film, a silicon nitride oxide film, or a silicon nitride film is used as the gate insulating film, silicon included in the gate insulating film may be mixed into the oxide semiconductor film. When silicon is included in the oxide semiconductor film, a decrease in crystallinity of the oxide semiconductor film, a decrease in carrier mobility, or the like occurs. Thus, the second layer is preferably provided between the first layer and the gate insulating film so that the concentration of silicon in the first layer where a channel is formed is reduced. For the same reason, it is preferable that a third layer which is formed of the constituent element of the first layer and whose electron affinity is lower than that of the first layer by 0.2 eV or more be provided and the first layer be sandwiched between the second layer and the third layer.

Such a structure makes it possible to reduce and further prevent diffusion of impurities such as silicon to a region where a channel is formed, so that a highly reliable transistor can be obtained.

In order to make the oxide semiconductor film a CAAC-OS film, the concentration of silicon in the oxide semiconductor film is set to lower than or equal to $2.5\times10^{21}/cm^3$. Preferably, the concentration of silicon in the oxide semiconductor film is lower than $1.4\times10^{21}/cm^3$, preferably lower than $4\times10^{19}/cm^3$, further preferably lower than $2.0\times10^{18}/cm^3$. This is because the field-effect mobility of the transistor may be reduced when the concentration of silicon in the oxide semiconductor film is $1.4\times10^{21}/cm^3$ or higher, and the oxide semiconductor film is made amorphous at the interface with a film in contact with the oxide semiconductor film when the concentration of silicon in the oxide semiconductor film is $4.0\times10^{19}/cm^3$ or higher. Further, when the concentration of silicon in the oxide semiconductor film is made lower than $2.0\times10^{18}/cm^3$, improvement in reliability of the transistor and a reduction in the density of state (DOS) in the oxide semiconductor film can be expected. Note that the concentration of silicon in the oxide semiconductor film can be measured by secondary ion mass spectroscopy (SIMS).

The semiconductor and the semiconductor film described in this embodiment can be used for a transistor in a display portion of a display unit included in an information processing device of one embodiment of the present invention. The method for driving an information processing device described in Embodiment 1 is applied, and a program for driving the information processing device described in Embodiment 1 is executed by the arithmetic portion, whereby eye fatigue of a user of the semiconductor device having a display function described in this embodiment can be suppressed, and eye-friendly display can be performed.

The transistor including the semiconductor film whose carrier density is sufficiently reduced, which is described in this embodiment, has extremely low off-state current. Thus, when the driving method described in Embodiment 3 is applied to an information processing device in which such a transistor is included in a display portion, a change in luminance can be suppressed even in the case where the refresh rate has an extremely small value.

This embodiment can be combined with any of the other embodiments disclosed in this specification as appropriate.

(Embodiment 7)

In this embodiment, a structure example of a transistor to which the oxide semiconductor film described in Embodiment 6 is applied will be described with reference to drawings.

[Structure Example of Transistor]

Figure 16A:
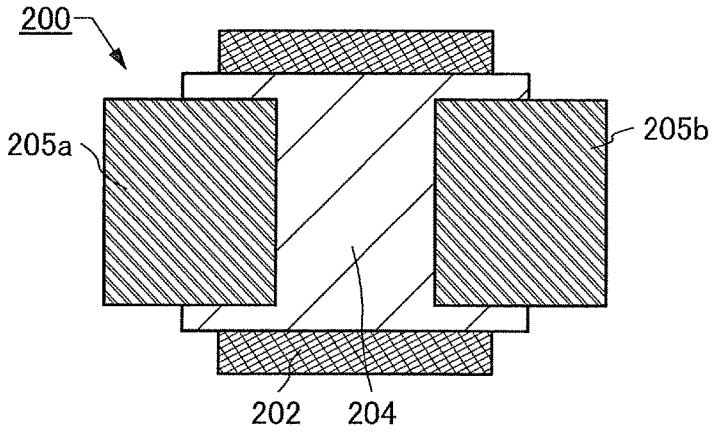
FIGS. 16A and 16B illustrate a structure example of a transistor according to Embodiment.
Figure 16B:
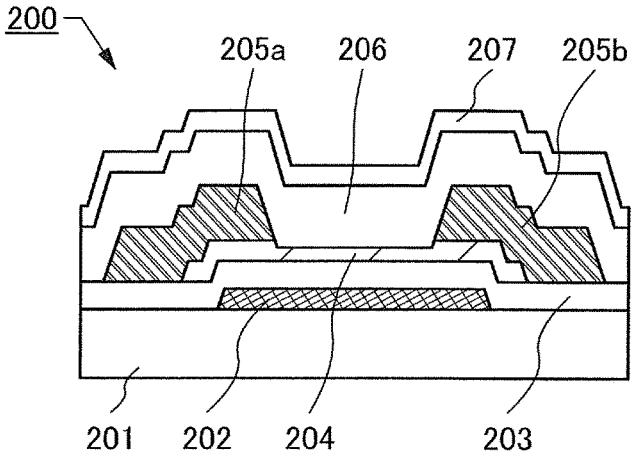

FIG. 16A is a top schematic view of a transistor 200 described below. FIG. 16B is a schematic cross-sectional view of the transistor 200 taken along a section line A-B in FIG. 16A. The transistor 200 exemplified by this structure example is a bottom-gate transistor.

The transistor 200 includes a gate electrode 202 over a substrate 201, an insulating layer 203 over the substrate 201 and the gate electrode 202, an oxide semiconductor layer 204 over the insulating layer 203, which overlaps with the gate electrode layer 202, and a pair of electrodes 205*a* and 205*b* which are in contact with a top surface of the oxide semiconductor layer 204. In addition, an insulating layer 206 covering the insulating layer 203, the oxide semiconductor layer 204, and the pair of electrodes 205*a* and 205*b*, and an insulating layer 207 over the insulating layer 206 are provided.

The oxide semiconductor film described in Embodiment 6 can be used for the oxide semiconductor layer 204 over the transistor 200.

[Substrate 201]

There is no particular limitation on the property of a material and the like of the substrate 201 as long as the material has heat resistance high enough to withstand at least heat treatment which will be performed later. For example, a glass substrate, a ceramic substrate, a quartz substrate, a sapphire substrate, or a yttria-stabilized zirconia (YSZ) substrate may be used as the substrate 201. Alternatively, a single crystal semiconductor substrate or a polycrystalline semiconductor substrate made of silicon, silicon carbide, or the like, a compound semiconductor substrate made of silicon germanium or the like, an SOI substrate, or the like can be used. Alternatively, any of these substrates over which a semiconductor element is provided may be used as the substrate 201.

Still alternatively, a flexible substrate such as a plastic substrate may be used as the substrate 201, and the transistor 200 may be provided directly on the flexible substrate. Alternatively, a separation layer may be provided between the substrate 201 and the transistor 200. The separation layer can be used when part or the whole of the transistor formed over the separation layer is formed and separated from the substrate 201 and transferred to another substrate. Thus, the transistor 200 can be transferred to a substrate having low heat resistance or a flexible substrate.

[Gate Electrode 202]

The gate electrode layer 202 can be formed using a metal selected from aluminum, chromium, copper, tantalum, titanium, molybdenum, and tungsten; an alloy containing any of these metals as a component; an alloy containing any of these metals in combination; or the like. Further, one or more metals selected from manganese and zirconium may be used. Further, the gate electrode 202 may have a single-layer structure or a stacked-layer structure of two or more layers. For example, a single-layer structure of an aluminum film containing silicon, a two-layer structure in which a titanium film is stacked over an aluminum film, a two-layer structure in which a titanium film is stacked over a titanium nitride film, a two-layer structure in which a tungsten film is stacked over a titanium nitride film, a two-layer structure in which a tungsten film is stacked over a tantalum nitride film or a tungsten nitride film, a three-layer structure in which a titanium film, an aluminum film, and a titanium film are stacked in this order, and the like can be given. Alternatively, an alloy film containing aluminum and one or more metals selected from titanium, tantalum, tungsten, molybdenum, chromium, neodymium, and scandium; or a nitride film of the alloy film may be used.

The gate electrode 202 can also be formed using a light-transmitting conductive material such as an indium tin oxide, an indium oxide containing a tungsten oxide, an indium zinc oxide containing a tungsten oxide, an indium oxide containing a titanium oxide, an indium tin oxide containing a titanium oxide, an indium zinc oxide, or an indium tin oxide to which a silicon oxide is added. It is also possible to have a stacked-layer structure formed using the above light-transmitting conductive material and the above metal.

Further, an In—Ga—Zn-based oxynitride semiconductor film, an In—Sn-based oxynitride semiconductor film, an In—Ga-based oxynitride semiconductor film, an In—Zn-based oxynitride semiconductor film, a Sn-based oxynitride semiconductor film, an In-based oxynitride semiconductor film, a film of metal nitride (such as InN or ZnN), or the like may be provided between the gate electrode layer 202 and the insulating layer 203. These films each have a work function higher than or equal to 5 eV, preferably higher than or equal to 5.5 eV, which is higher than the electron affinity of an oxide semiconductor; thus, the threshold voltage of a transistor including the oxide semiconductor can be shifted in the positive direction. Accordingly, a switching element having what is called normally-off characteristics can be obtained. For example, in the case of using an In—Ga—Zn-based oxynitride semiconductor film, an In—Ga—Zn-based oxynitride semiconductor film having a higher nitrogen concentration than at least the oxide semiconductor layer 204, specifically, an In—Ga—Zn-based oxynitride semiconductor film having a nitrogen concentration of 7 at. % or higher is used.

[Insulating layer 203]

The insulating layer 203 functions as a gate insulating film. The insulating layer 204 in contact with a bottom surface of the oxide semiconductor layer 204 is preferably an amorphous film.

The insulating layer 203 may be formed to have a single-layer structure or a stacked-layer structure using, for example, one or more of silicon oxide, silicon oxynitride, silicon nitride oxide, silicon nitride, aluminum oxide, hafnium oxide, gallium oxide, Ga—Zn-based metal oxide, silicon nitride, and the like.

The gate insulating layer 203 may be formed using a high-k material such as hafnium silicate ($HfSiO_x$), hafnium silicate to which nitrogen is added ($HfSi_xO_yN_z$), hafnium aluminate to which nitrogen is added ($HfAl_xO_yN_z$), hafnium oxide, or yttrium oxide, so that gate leakage current of the transistor can be reduced.

[Pair of Electrodes 205*a* and 205*b*]

The pair of electrodes 205*a* and 205*b* function as a source electrode or a drain electrode of the transistor.

The pair of electrodes 205*a* and 205*b* can be formed to have a single-layer structure or a stacked-layer structure using, as a conductive material, any of metals such as aluminum, titanium, chromium, nickel, copper, yttrium, zirconium, molybdenum, silver, tantalum, and tungsten, or an alloy containing any of these metals as its main component. For example, a single-layer structure of an aluminum film containing silicon, a two-layer structure in which a titanium film is stacked over an aluminum film, a two-layer structure in which a titanium film is stacked over a tungsten film, a two-layer structure in which a copper film is formed over a copper-magnesium-aluminum alloy film, a three-layer structure in which a titanium film or a titanium nitride film, an aluminum film or a copper film, and a titanium film or a titanium nitride film are stacked in this order, a three-layer structure in which a molybdenum film or a molybdenum nitride film, an aluminum film or a copper film, and a molybdenum film or a molybdenum nitride film are stacked in this order, and the like can be given. Note that a transparent conductive material containing indium oxide, tin oxide, or zinc oxide may be used.

[Insulating layers 206 and 207]

The insulating layer 206 is preferably formed using an oxide insulating film containing oxygen at a higher proportion than oxygen in the stoichiometric composition. Part of oxygen is released by heating from the oxide insulating film containing oxygen at a higher proportion than oxygen in the stoichiometric composition. The oxide insulating film containing oxygen at a higher proportion than oxygen in the stoichiometric composition is an oxide insulating film in which the amount of released oxygen converted into oxygen atoms is greater than or equal to $1.0\times10^{18}$ atoms/cm$^3$, preferably greater than or equal to $3.0\times10^{20}$ atoms/cm$^3$ in thermal desorption spectroscopy (TDS) analysis.

As the insulating layer 206, a silicon oxide film, a silicon oxynitride film, or the like can be formed.

Note that the insulating layer 206 also functions as a film which relieves damage to the oxide semiconductor layer 204 at the time of forming the insulating layer 207 later.

Alternatively, an oxide film through which oxygen penetrates may be provided between the insulating layer 206 and the oxide semiconductor layer 204.

As the oxide film through which oxygen penetrates, a silicon oxide film, a silicon oxynitride film, or the like can be formed. Note that in this specification, a "silicon oxynitride film" refers to a film that includes more oxygen than nitrogen, and a "silicon nitride oxide film" refers to a film that includes more nitrogen than oxygen.

The insulating layer 207 can be formed using an insulating film having a blocking effect against oxygen, hydrogen, water, and the like. It is possible to prevent outward diffusion of oxygen from the oxide semiconductor layer 204 and entry of hydrogen, water, or the like into the oxide semiconductor layer 204 from the outside by providing the insulating layer 207 over the insulating layer 206. As for the insulating film having a blocking effect against oxygen, hydrogen, water, and the like, a silicon nitride film, a silicon nitride oxide film, an aluminum oxide film, an aluminum oxynitride film, a gallium oxide film, a gallium oxynitride film, an yttrium oxide film, an yttrium oxynitride film, a hafnium oxide film, and a hafnium oxynitride film can be given as examples.

[Example of Method for Manufacturing Transistor]

Next, an example of a method for manufacturing the transistor 200 exemplified in FIGS. 16A and 16B is described.

Figure 17A:
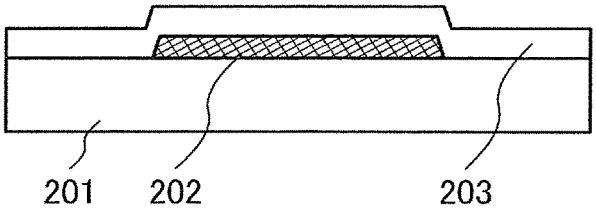
FIGS. 17A to 17D illustrate an example of a method for manufacturing a transistor according to Embodiment.

First, as illustrated in FIG. 17A, the gate electrode 202 is formed over the substrate 201, and the insulating layer 203 is formed over the gate electrode 202.

Here, a glass substrate is used as the substrate 201.

[Formation of Gate Electrode]

A method for forming the gate electrode 202 is described below. First, a conductive film is formed by a sputtering method, a CVD method, an evaporation method, or the like and then a resist mask is formed over the conductive film using a first photomask by a photolithography process. Then, part of the conductive film is etched using the resist mask to form the gate electrode 202. After that, the resist mask is removed.

Note that the gate electrode 202 may be formed by an electrolytic plating method, a printing method, an ink-jet method, or the like instead of the above formation method.

[Formation of Gate Insulating Layer]

The insulating layer 203 is formed by a sputtering method, a CVD method, an evaporation method, or the like.

In the case where the insulating layer 203 is formed using a silicon oxide film, a silicon oxynitride film, or a silicon nitride oxide film, a deposition gas containing silicon and an oxidizing gas are preferably used as a source gas. Typical examples of the deposition gas containing silicon include silane, disilane, trisilane, and silane fluoride. As the oxidizing gas, oxygen, ozone, dinitrogen monoxide, nitrogen dioxide, and the like can be given as examples.

In the case of forming a silicon nitride film as the insulating layer 203, it is preferable to use a two-step formation method. First, a first silicon nitride film with few defects is formed by a plasma CVD method in which a mixed gas of silane, nitrogen, and ammonia is used as a source gas. Then, a second silicon nitride film in which the hydrogen concentration is low and hydrogen can be blocked is formed by switching the source gas to a mixed gas of silane and nitrogen. With such a formation method, a silicon nitride film having few defects and a blocking property against hydrogen can be formed as the insulating layer 203.

Moreover, in the case of forming a gallium oxide film as the insulating layer 203, a metal organic chemical vapor deposition (MOCVD) method can be employed.

[Formation of Oxide Semiconductor Layer]

Figure 17B:
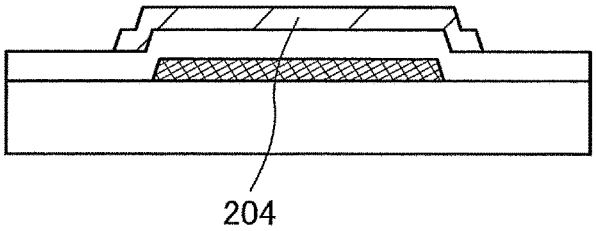

Next, as illustrated in FIG. 17B, an oxide semiconductor layer 204 is formed over the insulating layer 203.

A method for forming the oxide semiconductor layer 204 is described below. First, an oxide semiconductor film is formed using the method described in Embodiment 6. Then, a resist mask is formed over the oxide semiconductor film using a second photomask by a photolithography process. Then, part of the oxide semiconductor film is etched using the resist mask to form the oxide semiconductor layer 204. After that, the resist mask is removed.

After that, heat treatment may be performed. In such a case, the heat treatment is preferably performed in an atmosphere containing oxygen.

[Formation of Pair of Electrodes]

Figure 17C:
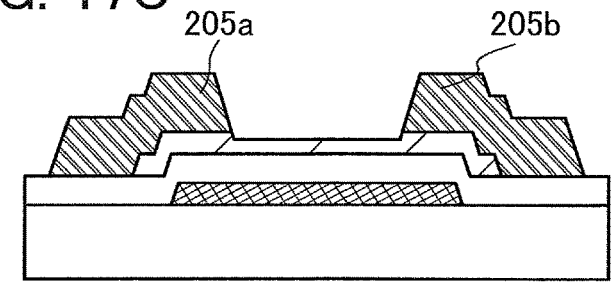

Next, as illustrated in FIG. 17C, the pair of electrodes 205*a* and 205*b* is formed.

A method for forming the pair of electrodes 205*a* and 205*b* is described below. First, a conductive film is formed by a sputtering method, a CVD method, an evaporation method, or the like. Then, a resist mask is formed over the conductive film using a third photomask by a photolithography process. Then, part of the conductive film is etched using the resist mask to form the pair of electrodes 205*a* and 205*b*. After that, the resist mask is removed.

Note that as illustrated in FIG. 17C, the upper part of the oxide semiconductor layer 204 is in some cases partly etched and thinned by the etching of the conductive film. For this reason, the oxide semiconductor layer 204 is preferably formed thick in advance.

[Formation of Insulating Layer]

Figure 17D:
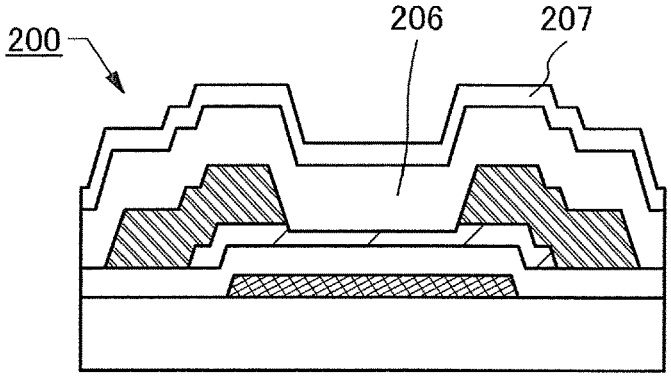

Next, as illustrated in FIG. 17D, the insulating layer 206 is formed over the oxide semiconductor layer 204 and the pair of electrodes 205*a* and 205*b*. Then, the insulating layer 207 is formed over the insulating layer 206.

In the case where the insulating layer 206 is formed using a silicon oxide film or a silicon oxynitride film, a deposition gas containing silicon and an oxidizing gas are preferably used as a source gas. Typical examples of the deposition gas containing silicon include silane, disilane, trisilane, and silane fluoride. As the oxidizing gas, oxygen, ozone, dinitrogen monoxide, nitrogen dioxide, and the like can be given as examples.

For example, a silicon oxide film or a silicon oxynitride film is formed under the conditions as follows: the substrate placed in a treatment chamber of a plasma CVD apparatus, which is vacuum-evacuated, is held at a temperature higher than or equal to 180° C. and lower than or equal to 260° C., preferably higher than or equal to 200° C. and lower than or equal to 240° C., the pressure is greater than or equal to 100 Pa and less than or equal to 250 Pa, preferably greater than or equal to 100 Pa and less than or equal to 200 Pa with introduction of a source gas into the treatment chamber, and high-frequency power higher than or equal to 0.17 $W/cm^2$ and lower than or equal to 0.5 $W/cm^2$, preferably higher than or equal to 0.25 $W/cm^2$ and lower than or equal to 0.35 $W/cm^2$ is supplied to an electrode provided in the treatment chamber.

As the film formation conditions, the high-frequency power having the above power density is supplied to the treatment chamber having the above pressure, whereby the degradation efficiency of the source gas in plasma is increased, oxygen radicals are increased, and oxidation of the source gas is promoted; therefore, oxygen is contained in the oxide insulating film at a higher proportion than oxygen in the stoichiometric composition. However, in the case where the substrate temperature is within the above temperature range, the bond between silicon and oxygen is weak, and accordingly, part of oxygen is released by heating. Thus, it is possible to form an oxide insulating film which contains oxygen at a higher proportion than the stoichiometric composition and from which part of oxygen is released by heating.

Further, in the case of providing an oxide insulating film between the oxide semiconductor layer 204 and the insulating layer 206, the oxide insulating film serves as a protective film of the oxide semiconductor layer 204 in the steps of forming the insulating layer 206. Thus, the insulating layer 206 can be formed using the high-frequency power having a high power density while damage to the oxide semiconductor layer 204 is reduced.

For example, a silicon oxide film or a silicon oxynitride film is formed as the oxide insulating film under the conditions as follows: the substrate placed in a treatment chamber of a plasma CVD apparatus, which is vacuum-evacuated, is held at a temperature higher than or equal to 180° C. and lower than or equal to 400° C., preferably higher than or equal to 200° C. and lower than or equal to 370° C., the pressure is greater than or equal to 20 Pa and less than or equal to 250 Pa, preferably greater than or equal to 100 Pa and less than or equal to 250 Pa with introduction of a source gas into the treatment chamber, and high-frequency power is supplied to an electrode provided in the treatment chamber. Further, when the pressure in the treatment chamber is greater than or equal to 100 Pa and less than or equal to 250 Pa, damage to the oxide semiconductor layer 204 can be reduced.

A deposition gas containing silicon and an oxidizing gas are preferably used as a source gas of the oxide insulating film. Typical examples of the deposition gas containing silicon include silane, disilane, trisilane, and silane fluoride. As the oxidizing gas, oxygen, ozone, dinitrogen monoxide, nitrogen dioxide, and the like can be given as examples.

The insulating layer 207 can be formed by a sputtering method, a CVD method, or the like.

In the case where the insulating layer 207 is formed using a silicon nitride film or a silicon nitride oxide film, a deposition gas containing silicon, an oxidizing gas, and a gas containing nitrogen are preferably used as a source gas. Typical examples of the deposition gas containing silicon include silane, disilane, trisilane, and silane fluoride. As the oxidizing gas, oxygen, ozone, dinitrogen monoxide, nitrogen dioxide, and the like can be given as examples. As the gas containing nitrogen, nitrogen and ammonia can be given as examples.

Through the above process, the transistor 200 can be formed.

[Modification Example of Transistor 200]

A structure example of a transistor which is partly different from the transistor 200 is described below.

[Modification Example 1]

Figure 18A:
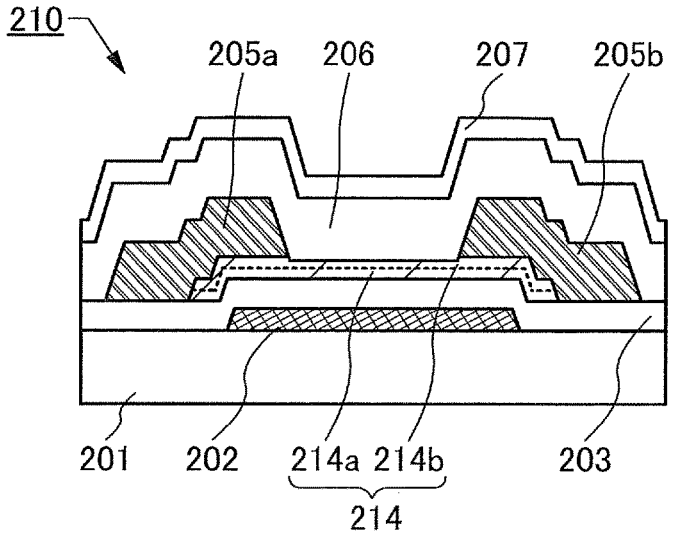
FIGS. 18A and 18B each illustrate a structure example of a transistor according to Embodiment.

FIG. 18A is a cross-sectional schematic view of a transistor 210 exemplified below. In the transistor 210, a structure of an oxide semiconductor layer is different from that of the transistor 200.

An oxide semiconductor layer 214 in the transistor 210 has a structure in which an oxide semiconductor layer 214*a* and an oxide semiconductor layer 214*b* are stacked.

Since a boundary between the oxide semiconductor layer 214*a* and the oxide semiconductor layer 214*b* is not clear in some cases, the boundary is shown by a dashed line in FIG. 18A and the like.

The oxide semiconductor film of one embodiment of the present invention can be used for one or both of the oxide semiconductor layer 214*a* and the oxide semiconductor layer 214*b*.

For example, for the oxide semiconductor layer 214*a*, an In—Ga oxide, an In—Zn oxide, or an In-M-Zn oxide (M represents Al, Ti, Ga, Y, Zr, La, Ce, Nd, or Hf) is typically used. Note that when the oxide semiconductor layer 214*a* is an In-M-Zn oxide, the atomic ratio of In to M is preferably as follows: the proportion of In atoms be lower than 50 atomic % and the proportion of M atoms be higher than or equal to 50 atomic %, and it is further preferable as follows: the proportion of In atoms be lower than 25 atomic % and the proportion of M atoms be higher than or equal to 75 atomic %. The energy gap of the oxide semiconductor layer 214*a* is 2 eV or more, preferably 2.5 eV or more, further preferably 3 eV or more.

For example, the oxide semiconductor layer 214*b* contains In or Ga and typically is an In—Ga oxide, an In—Zn oxide, or an In-M-Zn oxide (M represents Al, Ti, Ga, Y, Zr, La, Ce, Nd, or Hf). The energy at the bottom of the conduction band is closer to a vacuum level than that of the oxide semiconductor layer 214*a* is, and typically, the difference between the energy at the bottom of the conduction band of the oxide semiconductor layer 214*b* and the energy at the bottom of the conduction band of the oxide semiconductor layer 214*a* is any one or more of 0.05 eV or more, 0.07 eV or more, 0.1 eV or more, and 0.15 eV or more, and any one or more of 2 eV or less, 1 eV or less, 0.5 eV or less, and 0.4 eV or less.

When an In-M-Zn oxide is used as the oxide semiconductor layer 214*b*, the atomic ratio between In and M preferably has the following relation: the atomic percentage of In is greater than or equal to 25 atomic % and the atomic percentage of M is less than 75 atomic %; further preferably, the atomic percentage of In is greater than or equal to 34 atomic % and the atomic percentage of M is less than 66 atomic %.

For example, as the oxide semiconductor layer 214*a*, an In—Ga—Zn oxide with an atomic ratio of In to Ga and Zn that is 1:1:1 or 3:1:2 can be used. Further, as the oxide semiconductor layer 214*b*, an In—Ga—Zn oxide with an atomic radio of In to Ga and Zn that is 1:3:2, 1:6:4, or 1:9:6 can be used. Note that in each of the oxide semiconductor layer 214*a* and the oxide semiconductor layer 214*b*, the proportion of each atom in the atomic ratio varies within a range of ±20% as an error.

An oxide containing a large amount of Ga, which functions as a stabilizer, is used for the oxide semiconductor layer 214*b* provided as the upper layer, whereby a release of oxygen from the oxide semiconductor layer 214*a* and the oxide semiconductor layer 214*b* can be suppressed.

Note that, without limitation to those described above, a material with an appropriate composition may be used depending on required semiconductor characteristics and electrical characteristics (e.g., field-effect mobility and threshold voltage) of a transistor. Further, in order to obtain required semiconductor characteristics of a transistor, it is preferable that the carrier density, the impurity concentration, the defect density, the atomic ratio of a metal element to oxygen, the interatomic distance, the density, and the like of the oxide semiconductor layer 214*a* and the oxide semiconductor layer 214*b* be set to be appropriate.

Although the oxide semiconductor layer 214 with a structure in which two oxide semiconductor layers are stacked is described above, the oxide semiconductor layer may have a structure in which three or more oxide semiconductor layers are stacked.

[Modification Example 2]

Figure 18B:
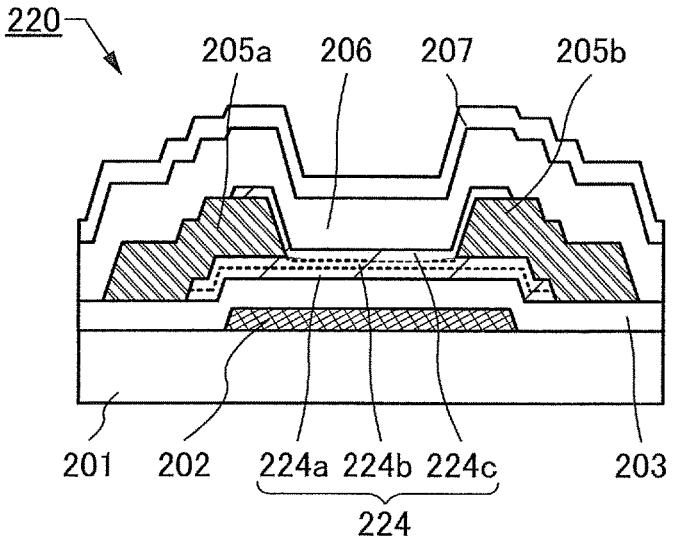

FIG. 18B is a cross-sectional schematic view of a transistor 220 described below. In the transistor 220, a structure of an oxide semiconductor layer is different from those of the transistor 200 and the transistor 210.

An oxide semiconductor layer 224 in the transistor 220 has a structure in which an oxide semiconductor layer 224*a*, an oxide semiconductor layer 224*b*, and an oxide semiconductor layer 224*c* are stacked in this order.

The oxide semiconductor layer 224*a* and the oxide semiconductor layer 224*b* are stacked over the insulating layer 203. The oxide semiconductor layer 224*c* is provided to be in contact with a top surface of the oxide semiconductor layer 224*b* and top surfaces and side surfaces of the pair of electrodes 205*a* and 205*b*.

The oxide semiconductor film described in Embodiment 6 can be used for one or more layers of the oxide semiconductor layer 224*a*, the oxide semiconductor layer 224*b*, and the oxide semiconductor layer 224*c*.

For example, a structure similar to that of the oxide semiconductor layer 214*a* described in Modification Example 1 can be used for the oxide semiconductor layer 224*b*. Alternatively, a structure similar to the oxide semiconductor layer 214*b* described in Modification Example 1 can be used for the oxide semiconductor layers 224*a* and 224*c*.

For example, an oxide containing a large amount of Ga, which functions as a stabilizer, is used for each of the oxide semiconductor layer 224*a* and the oxide semiconductor layer 224*c* provided below and over the oxide semiconductor layer 224*b*, whereby a release of oxygen from the oxide semiconductor layer 224*a*, the oxide semiconductor layer 224*b*, and the oxide semiconductor layer 224*c* can be suppressed.

Further, in the case where a channel is formed mainly in the oxide semiconductor layer 224*b*, for example, the amount of on-state current of the transistor 220 can be increased with a structure in which an oxide containing a large amount of In is used for the oxide semiconductor layer 224*b*, and the pair of electrodes 205*a* and 205*b* is provided in contact with the oxide semiconductor layer 224*b*.

[Another Structure Example of Transistor]

A structure example of a top-gate transistor to which the oxide semiconductor film of one embodiment of the present invention can be applied is described below.

Note that descriptions of components having structures or functions similar to those of the above, which are denoted by the same reference numerals, are omitted below.

[Structure Example]

Figure 19A:
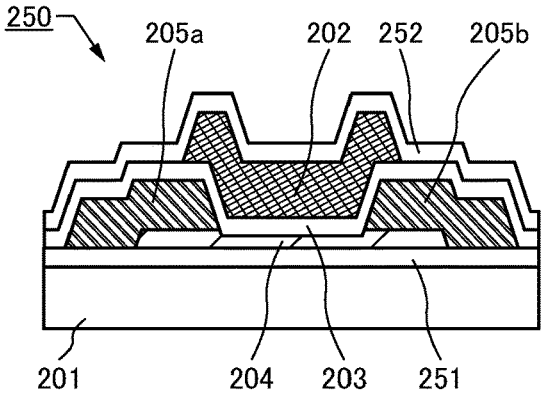
FIGS. 19A to 19C each illustrate a structure example of a transistor according to Embodiment.

FIG. 19A is a cross-sectional schematic view of a top-gate transistor 250 described below.

The transistor 250 includes an oxide semiconductor layer 204 provided over the substrate 201 provided with an insulating layer 251, the pair of electrodes 205*a* and 205*b* in contact with a top surface of the oxide semiconductor layer 204, the insulating layer 203 over the oxide semiconductor layer 204 and the pair of electrodes 205*a* and 205*b*, and the gate electrode 202 provided so as to overlap with the oxide semiconductor layer 204 with the insulating layer 203 provided therebetween. Moreover, an insulating layer 252 is provided to cover the insulating layer 203 and the gate electrode 202.

The oxide semiconductor film described in Embodiment 6 can be used for the oxide semiconductor layer 204 of the transistor 250.

The insulating layer 251 has a function of suppressing diffusion of impurities from the substrate 201 to the oxide semiconductor layer 204. For example, a structure similar to that of the insulating layer 207 can be employed. Note that the insulating layer 251 is not necessarily provided when not needed.

The insulating layer 252 can be formed using an insulating film having a blocking effect against oxygen, hydrogen, water, and the like in a manner similar to that of the insulating layer 207. Note that the insulating layer 207 is not necessarily provided.

[Modification Example]

A structure example of a transistor which is partly different from the transistor 250 is described below.

Figure 19B:
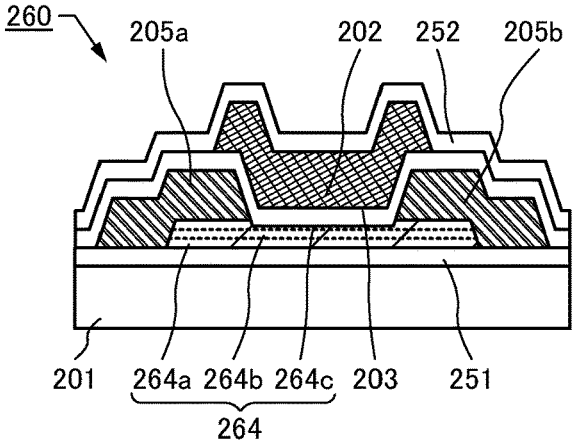

FIG. 19B is a cross-sectional schematic view of a transistor 260 described below. In the transistor 260, a structure of an oxide semiconductor layer is different from that of the transistor 250.

An oxide semiconductor layer 264 in the transistor 260 has a structure in which an oxide semiconductor layer 264*a*, an oxide semiconductor layer 264*b*, and an oxide semiconductor layer 264*c* are stacked.

The oxide semiconductor film described in Embodiment 6 can be used for one or more layers of the oxide semiconductor layer 264*a*, the oxide semiconductor layer 264*b*, and the oxide semiconductor layer 264*c*.

For example, a structure similar to that of the oxide semiconductor layer 214*a* described in Modification Example 1 can be used for the oxide semiconductor layer 264*b*. Alternatively, a structure similar to that of the oxide semiconductor layer 214*b* described in Modification Example 1 can be used for the oxide semiconductor layers 264*a* and 264*c*.

For example, an oxide containing a large amount of Ga, which functions as a stabilizer, is used for each of the oxide semiconductor layer 264*a* and the oxide semiconductor layer 264*c* provided below and over the oxide semiconductor layer 264*b*, whereby a release of oxygen from the oxide semiconductor layer 264*a*, the oxide semiconductor layer 264*b*, and the oxide semiconductor layer 264*c* can be suppressed.

For example, in formation of the oxide semiconductor layer 264, an oxide semiconductor film that is to be the oxide semiconductor layer 264*a* is exposed by processing the oxide semiconductor layer 264*c* and the oxide semiconductor layer 264*b* by etching, and then the oxide semiconductor film is processed by dry etching, whereby the oxide semiconductor layer 264*a* is formed. In that case, a reaction product may be attached on side surfaces of the oxide semiconductor layer 264*b* and the oxide semiconductor layer 264*c* to form a sidewall protective layer (also referred to as a rabbit ear). Note that the reaction product may be attached by a sputtering phenomenon or through plasma at the time of the dry etching.

Figure 19C:
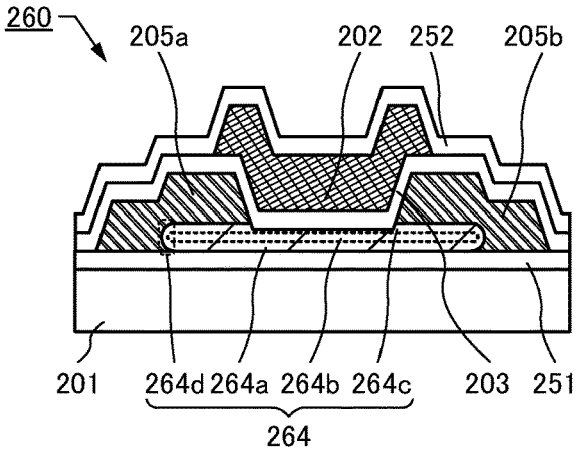

FIG. 19C is a cross-sectional schematic view of the transistor 260 in which a sidewall protective layer 264*d* is formed on the side surfaces of the oxide semiconductor layer 264 in the above manner.

The sidewall protective layer 264*d* mainly contains the same material as the oxide semiconductor layer 264*a*. Further, the sidewall protective layer 264*d*, in some cases, contains a component such as silicon of a layer provided below the oxide semiconductor layer 264*a* (here, the layer is the insulating layer 251).

Further, as illustrated in FIG. 19C, the side surfaces of the oxide semiconductor layer 264*b* can be covered with the sidewall protective layer 264*d* so as not to be in contact with the pair of electrodes 205*a* and 205*b*. With such a structure, particularly in the case where a channel is formed mainly in the oxide semiconductor layer 264*b*, the unintended leakage current when the transistor is off can be suppressed, and excellent off-state characteristics of the transistor can be achieved. Moreover, when a material containing a large amount of Ga, which functions as a stabilizer, is used for the sidewall protective layer 264*d*, a release of oxygen from the side surfaces of the oxide semiconductor layer 264*b* can be effectively suppressed, and thus, the transistor can have excellence in stability of the electrical characteristics.

Any of the transistors described in this embodiment can be used for a display portion of a display unit in an information processing device of one embodiment of the present invention. The method for driving an information processing device described in Embodiment 1 is applied and a program for driving the information processing device described in Embodiment 1 is executed to an arithmetic portion, whereby eye fatigue of a user of the semiconductor device having a display function described in this embodiment can be suppressed, and eye-friendly display can be performed.

The transistor including the semiconductor film whose carrier density is sufficiently reduced, which is described in this embodiment, has extremely low off-state current. Thus, when the driving method described in Embodiment 3 or the like is applied to an information processing device in which such a transistor is included in a display portion, a change in luminance can be suppressed even in the case where the refresh rate has an extremely small value.

This embodiment can be combined with any of the other embodiments disclosed in this specification as appropriate.

(Embodiment 8)

In this embodiment, examples of an information processing device of one embodiment of the present invention will be described with reference to FIGS. 20A to 20F.

Figure 20A:
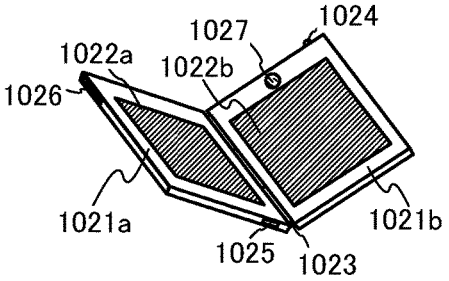
FIGS. 20A to 20F each illustrate an example of an information processing device according to Embodiment.

An information processing device illustrated in FIG. 20A is an example of a foldable information terminal The information processing device in FIG. 20A includes a housing 1021*a*, a housing 1021*b*, a panel 1022*a* incorporated in the housing 1021*a*, a panel 1022*b* incorporated in the housing 1021*b*, a hinge 1023, a button 1024, a connection terminal 1025, a storage medium insertion portion 1026, and a speaker 1027.

The housing 1021*a* and the housing 1021*b* are connected by the hinge 1023.

Since the information processing device in FIG. 20A includes the hinge 1023, it can be folded so that the panels 1022*a* and 1022*b* face each other.

The button 1024 is provided for the housing 1021*b*. Note that the housing 1021*a* may also be provided with the button 1024. For example, when the button 1024 having a function as a power button is provided, supply of power supply voltage to the information processing device can be controlled by pressing the button 1024.

The connection terminal 1025 is provided for the housing 1021*a*. Note that the connection terminal 1025 may be provided on the housing 1021*b*. Alternatively, a plurality of connection terminals 1025 may be provided on one or both of the housings 1021*a* and 1021*b*. The connection terminal 1025 is a terminal for connecting the information processing device illustrated in FIG. 20A to another device.

The storage media insertion portion 1026 is provided for the housing 1021*a*. The storage medium insertion portion 1026 may be provided on the housing 1021*b*. Alternatively, a plurality of storage medium insertion portions 1026 may be provided on one or both of the housings 1021*a* and 1021*b*. For example, a card storage medium is inserted into the storage medium insertion portion so that data can be read to the information processing device from the card storage medium or data stored in the information processing device can be written into the card storage medium.

The speaker 1027 is provided on the housing 1021*b*. The speaker 1027 outputs sound. Note that the speaker 1027 may be provided for the housing 1021*a*.

Note that the housing 1021*a* or the housing 1021*b* may be provided with a microphone, in which case the information processing device in FIG. 20A can function as a telephone set, for example.

The information processing device illustrated in FIG. 20A functions as one or more of a telephone set, an e-book reader, a personal computer, and a game machine, for example, and can be driven by the method described in any of the above embodiments.

Figure 20B:
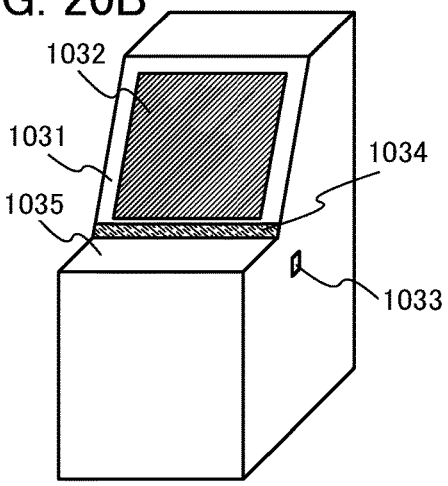

An information processing device illustrated in FIG. 20B is an example of a stationary information terminal. The information processing device in FIG. 20B includes a housing 1031, a panel 1032 incorporated in the housing 1031, a button 1033, and a speaker 1034.

Note that a panel similar to the panel 1032 may be provided for a deck portion 1035 of the housing 1031.

The housing 1031 may be provided with one or more of a ticket slot from which a ticket or the like is dispensed, a coin slot, and a bill slot.

The button 1033 is provided for the housing 1031. For example, when the button 1033 is a power button, supply of power supply voltage to the information processing device can be controlled by pressing the button 1033.

The speaker 1034 is provided for the housing 1031. The speaker 1034 outputs sound.

The information processing device in FIG. 20B serves as an automated teller machine, an information communication terminal (also referred to as multimedia station) for ordering a ticket or the like, or a game machine, for example, and can be driven by the method described in any of the above embodiments.

Figure 20C:
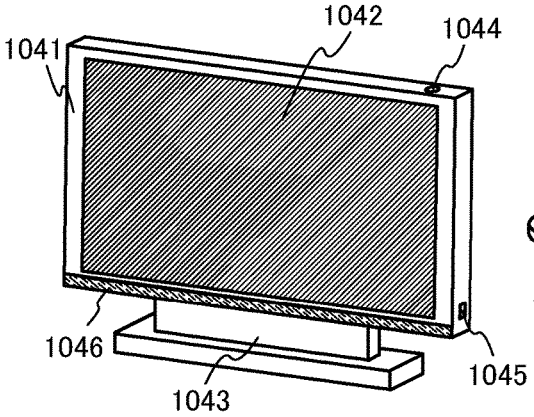

FIG. 20C illustrates an example of a stationary information terminal. The information processing device in FIG. 20C includes a housing 1041, a panel 1042 incorporated in the housing 1041, a support 1043 for supporting the housing 1041, a button 1044, a connection terminal 1045, and a speaker 1046.

Note that a connection terminal for connecting the housing 1041 to an external device may be provided.

The button 1044 is provided for the housing 1041. For example, when the button 1044 is a power button, supply of power supply voltage to the information processing device can be controlled by pressing the button 1044.

The connection terminal 1045 is provided for the housing 1041. The connection terminal 1045 is a terminal for connecting the information processing device in FIG. 20C to another device. For example, when the information processing device in FIG. 20C and a personal computer are connected with the connection terminal 1045, the panel 1042 can display an image corresponding to a data signal input from the personal computer. For example, when the panel 1042 of the information processing device in FIG. 20C is larger than a panel of another information processing device connected thereto, a displayed image of the other information processing device can be enlarged, so that a plurality of viewers can easily see the image at the same time.

The speaker 1046 is provided on the housing 1041. The speaker 1046 outputs sound.

The information processing device in FIG. 20C functions as at least one of an output monitor, a personal computer, and a television set, for example, and can be driven by the method described in any of the above embodiments.

Figure 20D:
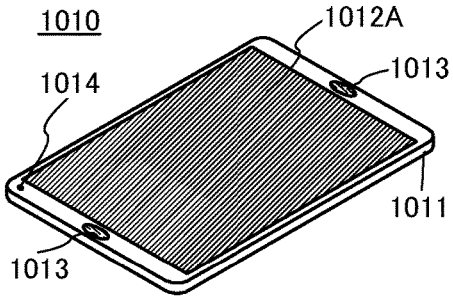
Figure 20E:
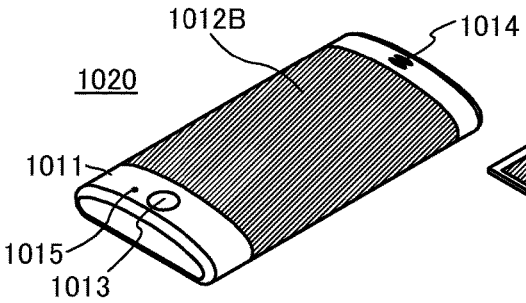

Information processing devices illustrated in FIGS. 20D and 20E are examples of portable information terminals.

A portable information terminal 1010 illustrated in FIG. 20D is provided with, in addition to a panel 1012A incorporated in a housing 1011, operation buttons 1013, and a speaker 1014. Further, although not shown, the portable information terminal 1010 includes a microphone, an external connection port such as a stereo headphone jack, an insertion port for a memory card, a camera, or a USB connector, and the like.

The portable information terminal 1010 in FIG. 20D can be driven by the method described in any of the above embodiments.

A portable information terminal 1020 illustrated in FIG. 20E is provided with a panel 1012B that is curved along the side surface of the housing 1011. When a substrate having a curved surface is used as a support substrate of a touch panel and a display element, a portable information terminal including a panel with a curved surface can be obtained.

The portable information terminal 1020 illustrated in FIG. 20E is provided with, in addition to a panel 1012B incorporated in the housing 1011, the operation button 1013, the speaker 1014, a microphone 1015, an external connection port which is not shown such as a stereo headphone jack, an insertion port for a memory card, a camera, or a USB connector, and the like.

The portable information terminals illustrated in FIGS. 20D and 20E each has a function of one or more of a telephone set, an e-book reader, a personal computer, and a game machine.

Figure 20F:
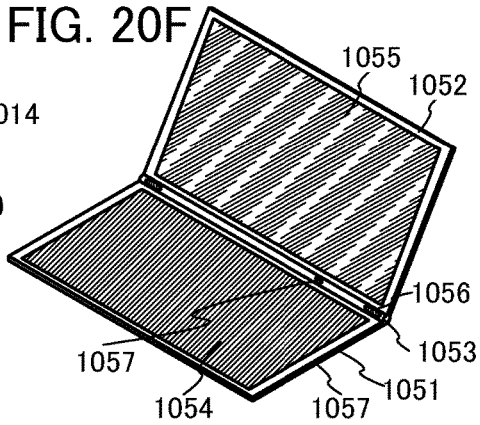

An information processing device illustrated in FIG. 20F is an example of a foldable information terminal The information processing device in FIG. 20F includes a housing 1051, a housing 1052, a panel 1054 incorporated in the housing 1051, a panel 1055 incorporated in the housing 1052, a speaker 1056, a startup button 1057, and a connection terminal 1025.

In the information processing device illustrated in FIG. 20F, the housing 1051 and the housing 1052 are connected to each other with a hinge 1053 and can be folded together.

The information processing device in FIG. 20F can be driven by the method described in any of the above embodiments.

For example, input keys of a keyboard or the like can be displayed on the panel 1054, and an application displayed on the panel 1055 can be operated by combination of touch operation on the input keys and input operation by a gesture toward the panel 1054.

The above is the description of the information processing devices illustrated in FIGS. 20A to 20F.

As described with reference to FIGS. 20A to 20F, the information processing device in this embodiment can be driven by the method described in any of the above embodiments. Thus, a variety of input methods can be employed and eyestrain on a user can be reduced.

The method for driving an information processing device described in Embodiment 1 is applied to the information processing devices described in this embodiment, and the program for driving the information processing device described in Embodiment 1 is applied to an arithmetic portion, whereby eye fatigue of a user can be suppressed, and eye-friendly display can be performed by the display units of the information processing devices in this embodiment.

This embodiment can be combined with any of the other embodiments disclosed in this specification as appropriate.

This application is based on Japanese Patent Application serial no. 2012-251548 filed with Japan Patent Office on Nov. 15, 2012, the entire contents of which are hereby incorporated by reference.

What is claimed is:

1. A method for driving an information processing device comprising:

a first period during which an image displayed on a display unit in accordance with an input signal is moved from a first coordinate to a third coordinate through a second coordinate; and a second period during which the image is displayed on the third coordinate, wherein a luminance of the image is lowered during moving the image from the first coordinate to the second coordinate, wherein the image is displayed in a display region, wherein the display region is displayed on the display unit by executing an application software, wherein a luminance of the display region is lowered during moving the image from the first coordinate to the second coordinate, wherein a transistor of the display region comprises:

a first oxide semiconductor layer;

a second oxide semiconductor layer over the first oxide semiconductor layer;

a third oxide semiconductor layer over the second oxide semiconductor layer; and a gate insulating layer and a gate electrode, wherein each of the first oxide semiconductor layer, the second oxide semiconductor layer, and the third oxide semiconductor layer comprises indium, gallium, and zinc, and wherein a proportion of gallium in each of the first oxide semiconductor layer and the third oxide semiconductor layer is higher than a proportion of gallium in the second oxide semiconductor layer.

2. The method for driving an information processing device according to claim 1, wherein the luminance of the image is lowered gradually.

3. The method for driving an information processing device according to claim 1, wherein a refresh rate of display on the display unit during the first period is higher than or equal to 30 Hz, and wherein a refresh rate of display on the display unit during the second period is lower than or equal to 5 Hz.

4. The method for driving an information processing device according to claim 1, wherein the display region is a window.

5. The method for driving an information processing device according to claim 1, wherein the transistor further comprises a sidewall protective layer, and wherein the sidewall protective layer is in contact with side walls of the first oxide semiconductor layer, the second oxide semiconductor layer, and the third oxide semiconductor layer.

6. A method for driving an information processing device comprising:

a first period during which an image displayed on a display unit in accordance with an input signal is moved from a first coordinate to a third coordinate through a second coordinate;

a second period during which the image is displayed on the third coordinate;

a first step of starting to move the image;

a second step of lowering a luminance of the image and a luminance of a display region; and a third step of stopping moving the image, wherein the image is displayed in the display region, wherein the display region is displayed on the display unit by executing an application software, wherein a transistor of the display region comprises:

a first oxide semiconductor layer;

a second oxide semiconductor layer over the first oxide semiconductor layer;

a third oxide semiconductor layer over the second oxide semiconductor layer; and a gate insulating layer and a gate electrode, wherein each of the first oxide semiconductor layer, the second oxide semiconductor layer, and the third oxide semiconductor layer comprises indium, gallium, and zinc, and wherein a proportion of gallium in each of the first oxide semiconductor layer and the third oxide semiconductor layer is higher than a proportion of gallium in the second oxide semiconductor layer.

7. The method for driving an information processing device according to claim 6, wherein the luminance of the image is lowered gradually.

8. The method for driving an information processing device according to claim 6, wherein a refresh rate of display on the display unit during the first period is higher than or equal to 30 Hz, and wherein a refresh rate of display on the display unit during the second period is lower than or equal to 5 Hz.

9. The method for driving an information processing device according to claim 6, further comprising a step of checking whether the image reaches the second coordinate.

10. The method for driving an information processing device according to claim 6, wherein the first step and the second step are performed concurrently.

11. The method for driving an information processing device according to claim 6, wherein the second step is performed before the first step.

12. The method for driving an information processing device according to claim 6, wherein the display region is a window.

13. The method for driving an information processing device according to claim 6, wherein the transistor further comprises a sidewall protective layer, and wherein the sidewall protective layer is in contact with side walls of the first oxide semiconductor layer, the second oxide semiconductor layer, and the third oxide semiconductor layer.

14. An information processing device comprising a display unit, an input unit, an arithmetic portion, and a memory unit, wherein a program is stored in the memory unit, wherein the program makes the arithmetic portion execute driving the information processing device, and wherein the program comprises:

a first period during which an image displayed on the display unit in accordance with an input signal is moved from a first coordinate to a third coordinate through a second coordinate;

a second period during which the image is displayed on the third coordinate;

a first step of starting to move the image;

a second step of lowering a luminance of the image and a luminance of a display region; and a third step of stopping moving the image, wherein the image is displayed in the display region, wherein the display region is displayed on the display unit by executing an application software, wherein a transistor of the display region comprises:

a first oxide semiconductor layer;

a second oxide semiconductor layer over the first oxide semiconductor layer;

a third oxide semiconductor layer over the second oxide semiconductor layer; and a gate insulating layer and a gate electrode, wherein each of the first oxide semiconductor layer, the second oxide semiconductor layer, and the third oxide semiconductor layer comprises indium, gallium, and zinc, and wherein a proportion of gallium in each of the first oxide semiconductor layer and the third oxide semiconductor layer is higher than a proportion of gallium in the second oxide semiconductor layer.

15. The information processing device according to claim 14, wherein the luminance of the image is lowered gradually.

16. The information processing device according to claim 14, wherein a refresh rate of display on the display unit during the first period is higher than or equal to 30 Hz, and wherein a refresh rate of display on the display unit during the second period is lower than or equal to 5 Hz.

17. The information processing device according to claim 14, further comprising a step of checking whether the image reaches the second coordinate.

18. The information processing device according to claim 14, wherein the first step and the second step are performed concurrently.

19. The information processing device according to claim 14, wherein the second step is performed before the first step.

20. The information processing device according to claim 14, wherein the display region is a window.

21. The information processing device according to claim 14, wherein the transistor further comprises a sidewall protective layer, and wherein the sidewall protective layer is in contact with side walls of the first oxide semiconductor layer, the second oxide semiconductor layer, and the third oxide semiconductor layer.

* * * * *